US007878711B2

(12) United States Patent
Morita

(10) Patent No.: US 7,878,711 B2
(45) Date of Patent: Feb. 1, 2011

(54) STORAGE BAG

(75) Inventor: Shuji Morita, Aichi (JP)

(73) Assignee: Daiwa Gravure Co., Ltd., Aichi (JP)

( * ) Notice: Subject to any disclaimer, the term of this patent is extended or adjusted under 35 U.S.C. 154(b) by 590 days.

(21) Appl. No.: 12/010,008

(22) Filed: Jan. 18, 2008

(65) Prior Publication Data

US 2008/0175521 A1 Jul. 24, 2008

(30) Foreign Application Priority Data

Jan. 19, 2007 (JP) ..... 2007-010060
Nov. 28, 2007 (JP) ..... 2007-307427

(51) Int. Cl.
*B65D 30/16* (2006.01)
*B65D 30/00* (2006.01)

(52) U.S. Cl. ..... 383/104; 383/107

(58) Field of Classification Search ..... 383/104, 383/120, 122, 107
See application file for complete search history.

(56) References Cited

U.S. PATENT DOCUMENTS

| | | | | |
|---|---|---|---|---|
| 3,438,567 | A * | 4/1969 | Bell, Jr. | 383/104 |
| 5,195,829 | A | 3/1993 | Watkins et al. | |
| 5,350,240 | A * | 9/1994 | Billman et al. | 383/104 |
| 7,055,683 | B2 * | 6/2006 | Bourque et al. | 206/219 |
| 7,306,095 | B1 * | 12/2007 | Bourque et al. | 206/219 |
| 2002/0186900 | A1 * | 12/2002 | Horne | 383/104 |

FOREIGN PATENT DOCUMENTS

| | | | |
|---|---|---|---|
| DE | 10201638 | A1 * | 7/2003 |
| EP | 1431207 | | 6/2004 |
| GB | 2230510 | | 10/1990 |
| JP | 05-330561 | | 12/1993 |
| JP | 08-324588 | | 10/1996 |
| JP | 09-221111 | | 8/1997 |
| JP | 10095439 | A * | 4/1998 |
| JP | 2006-204529 | | 8/2006 |
| WO | 98/23499 | | 6/1998 |

* cited by examiner

*Primary Examiner*—Jes F Pascua
(74) *Attorney, Agent, or Firm*—Lowe Hauptman Ham & Berner LLP

(57) ABSTRACT

Contour of a storage section of a three-sided bag is formed of (1) two side inner lines in a longitudinal direction, (2) two tilt inner lines which tilt inside with forming an obtuse angle with each side inner line from a lower end of each side inner line, and (3) one lower side inner line in a lateral direction which connects lower ends of respective tilt inner lines. A longitudinal size "a" of an intersection IPa of the side inner line and tilt inner line on the basis of an intersection BP of a side outer line or its extension, and a lower side outer line or its extension is preferably within a range of 0.08A to 0.71A, and a lateral size "b" of an intersection IPb of the tilt inner line and lower side inner line on the basis of an intersection BP is preferably within a range of 0.12B to 0.48B.

12 Claims, 17 Drawing Sheets

Fig. 4

| LONGITUDINAL SIZE : a | 0.00B | 0.10B | 0.11B | 0.12B | 0.15B | 0.20B | 0.25B | 0.30B | 0.35B | 0.40B | 0.45B | 0.48B | 0.49B | 0.50B |
|---|---|---|---|---|---|---|---|---|---|---|---|---|---|---|
| 1.00A | — | × | × | × | × | × | × | × | × | × | × | × | × | × |
| 0.95A | — | × | × | × | × | × | × | × | × | × | × | × | × | × |
| 0.90A | — | × | × | × | × | × | × | × | × | × | × | × | × | × |
| 0.85A | — | × | × | × | × | × | × | × | × | × | × | × | × | × |
| 0.80A | — | × | × | × | × | × | × | × | × | × | × | × | × | × |
| 0.75A | — | × | × | × | × | × | × | × | × | × | × | × | × | × |
| 0.72A | — | × | × | × | × | × | × | × | × | × | × | × | × | × |
| 0.71A | — | × | × | △ | △ | △ | △ | △ | △ | △ | △ | △ | × | × |
| 0.70A | — | × | × | △ | △ | △ | △ | △ | △ | △ | △ | △ | × | × |
| 0.66A | — | × | × | △ | △ | △ | △ | △ | △ | △ | △ | △ | × | × |
| 0.65A | — | × | × | △ | △ | ○ | ○ | ○ | ○ | ○ | △ | △ | × | × |
| 0.60A | — | × | × | △ | △ | ○ | ○ | ○ | ○ | ○ | △ | △ | × | × |
| 0.55A | — | × | × | △ | △ | ○ | ○ | ○ | ○ | ○ | △ | △ | × | × |
| 0.50A | — | × | × | △ | △ | ○ | ○ | ○ | ○ | ○ | △ | △ | × | × |
| 0.45A | — | × | × | △ | △ | ○ | ○ | ○ | ○ | ○ | △ | △ | × | × |
| 0.40A | — | × | × | △ | △ | ○ | ○ | ○ | ○ | ○ | △ | △ | × | × |
| 0.35A | — | × | × | △ | △ | ○ | ○ | ○ | ○ | ○ | △ | △ | × | × |
| 0.30A | — | × | × | △ | △ | ○ | ○ | ○ | ○ | ○ | △ | △ | × | × |
| 0.25A | — | × | × | △ | △ | ○ | ○ | ○ | ○ | ○ | △ | △ | × | × |
| 0.20A | — | × | × | △ | △ | ○ | ○ | ○ | ○ | ○ | △ | △ | × | × |
| 0.15A | — | × | × | △ | △ | ○ | ○ | ○ | ○ | ○ | △ | △ | × | × |
| 0.10A | — | × | × | △ | △ | △ | △ | △ | △ | △ | △ | △ | × | × |
| 0.08A | — | × | × | △ | △ | △ | △ | △ | △ | △ | △ | △ | × | × |
| 0.07A | — | × | × | × | × | × | × | × | × | × | × | × | × | × |
| 0.00A | — | — | — | — | — | — | — | — | — | — | — | — | — | — |

LATERAL SIZE : b

Fig. 11

| LONGITUDINAL SIZE : a 1 | 0.00B | 0.01B | 0.04B | 0.08B | 0.12B | 0.16B | 0.20B | 0.24B | 0.28B | 0.32B | 0.36B | 0.40B | 0.44B | 0.47B | 0.48B |
|---|---|---|---|---|---|---|---|---|---|---|---|---|---|---|---|
| 0.71A | — | — | — | — | — | — | — | — | — | — | — | — | — | — | — |
| 0.70A | — | ○ | — | — | — | — | — | — | — | — | — | — | — | — | — |
| 0.65A | — | ○ | — | — | — | — | — | — | — | — | — | — | — | — | — |
| 0.60A | — | ○ | ○ | — | — | — | — | — | — | — | — | — | — | — | — |
| 0.55A | — | ○ | ○ | ○ | ○ | — | — | — | — | — | — | — | — | — | — |
| 0.50A | — | ○ | ○ | ○ | ○ | ○ | — | — | — | — | — | — | — | — | — |
| 0.45A | — | ○ | ○ | ○ | ○ | ○ | — | — | — | — | — | — | — | — | — |
| 0.40A | — | ○ | ○ | ○ | ○ | ○ | ○ | — | — | — | — | — | — | — | — |
| 0.35A | — | ○ | ○ | ○ | ○ | ○ | ○ | ○ | — | — | — | — | — | — | — |
| 0.30A | — | ○ | ○ | ○ | ○ | ○ | ○ | ○ | — | — | — | — | — | — | — |
| 0.25A | — | ○ | ○ | ○ | ○ | ○ | ○ | ○ | ○ | — | — | — | — | — | — |
| 0.20A | — | ○ | ○ | ○ | ○ | ○ | ○ | ○ | ○ | ○ | — | — | — | — | — |
| 0.15A | — | ○ | ○ | ○ | ○ | ○ | ○ | ○ | ○ | ○ | ○ | — | — | — | — |
| 0.10A | — | ○ | ○ | ○ | ○ | ○ | ○ | ○ | ○ | ○ | ○ | ○ | — | — | — |
| 0.05A | — | ○ | ○ | ○ | ○ | ○ | ○ | ○ | ○ | ○ | ○ | ○ | — | — | — |
| 0.01A | — | ○ | ○ | ○ | ○ | ○ | ○ | ○ | ○ | ○ | ○ | ○ | ○ | ○ | — |
| 0.00A | — | — | — | — | — | — | — | — | — | — | — | — | — | — | — |

LATERAL SIZE : b 1

STORAGE BAG

BACKGROUND OF THE INVENTION

1. Field of the Invention

The present invention relates to a flat bag type storage bag having a storage section with an upper opening.

2. Description of the Related Art

A three-sided bag widely known as a flat bag type storage bag is constructed of two sheets of films with the same shape, and has two sides in a longitudinal direction and one lower side in a lateral direction, which have predetermined seal width. In addition, a twofold bag widely known as a flat bag type storage bag is constructed of one sheet of film with a predetermined shape, and has one back side in a longitudinal direction and one lower side in a lateral direction, which have predetermined seal width.

Each storage section of these three-sided bag and twofold bag has contour (usually rectangle) formed of both side inner lines and a lower side inner line. In addition, an upper opening of each storage section of these three-sided bag and twofold bag is heat sealed after storing contents, such as a liquid or powder, in the storage section.

When displaying the three-sided bag and twofold bag as articles after containing the contents, using back and lateral support plates, a method of piling up in a vertical direction in a state that the articles are laid down, or a method of arranging the articles so that the articles in a front side may lean against the articles in a back side one by one are generally adopted. However, also in the case of both exhibition methods, since postures of residual articles change easily when an article after exhibition is taken out by a buyer, exhibition forms of articles are easily disordered. A two-sided bag widely known as a flat bag type storage bag may also generate the same malfunction as described above.

For preventing that the exhibition form of articles are disordered, what is necessary is just to use a standing pouch, which enables self-supporting after storing contents, instead of the above-mentioned flat bag. However, since a bottom face formation film is necessary for a standing pouch, not only a material cost becomes expensive in comparison with the flat bag including the three-sided bag, the twofold bag, and the two-sided bag, even as production process also becomes complicated in comparison with the flat bag including the three-sided bag, twofold bag, and two-sided bag. Hence, its unit price is higher than that of the flat bag.

In short, when it is possible to provide what enables self-supporting after content storage similarly to the standing pouch as the flat bag including the three-sided bag, the twofold bag, and the two-sided bag, not only a benefit is obtained by a cost aspect for the manufacturer who uses a storage bag for a selling merchandise, even as the benefit of this cost aspect is reflected in article price, hence it becomes advantage also for a buyer.

BRIEF SUMMARY OF THE INVENTION

An object of the present invention is to provide a flat bag type storage bag including a three-sided bag, twofold bag, and two-sided bag which enable self-supporting after content storage.

In order to achieve the above-described object, the present invention is a storage bag which is a flat bag type storage bag including a three-sided bag, a twofold bag, and a two-sided bag; the storage bag having a predetermined whole longitudinal size, a predetermined whole lateral size, and a storage section with an upper opening; comprises: a contour of the storage section being formed of two side inner lines in a longitudinal direction, two tilt inner lines which tilt inside with forming an obtuse angle with each of the side inner lines from lower ends of the side inner lines, and one lower side inner line in a lateral direction which connects lower ends of the tilt inner lines; wherein with letting the whole longitudinal size be "A", letting the whole lateral size be "B", letting intersections of two side outer lines or their extensions, and a lower side outer line or its extension be BP, letting intersections of the side inner lines and the tilt inner lines be IPa, and letting intersections of the tilt inner lines and the lower side inner line be IPb, longitudinal sizes "a" of the intersections IPa on the basis of the intersections BP are within a range of 0.08A to 0.71A, and lateral sizes "b" of the intersections IPb on the basis of the intersections BP are within a range of 0.12B to 0.48B.

According to this storage bag, by letting the longitudinal size "a" of the intersection IPa on the basis of the intersection BP be within a range of 0.08A to 0.71A and letting the lateral size "b" of the intersection IPb on the basis of the intersection BP be within a range of 0.12B to 0.48B, it is possible to enable self-supporting, of the storage bag after storing contents, such as a liquid or powder, in a storage section.

In addition, the present invention is a storage bag which is a flat bag type storage bag including a three-sided bag, a twofold bag, and a two-sided bag; the storage bag having a predetermined whole longitudinal size, a predetermined whole lateral size, and a storage section with an upper opening; comprises: a contour of the storage section being formed of two side inner lines in a longitudinal direction, two first tilt inner lines which tilt inside with forming an obtuse angle with each of the side inner lines from lower ends of the side inner lines, two second tilt inner lines which tilt inside with forming an obtuse angle with each of the first tilt inner lines from lower ends of the first tilt inner lines, and one lower side inner line in a lateral direction which connects lower ends of the second tilt inner lines; wherein with letting the whole longitudinal size be "A", letting the whole lateral size be "B", letting intersections of two side outer lines or their extensions, and a lower side outer line or its extension be BP, letting intersections of the side inner lines and the first tilt inner lines be IPa, letting intersections of the second tilt inner lines and the lower side inner line be IPb, and letting intersections of the first tilt inner lines and the second tilt inner lines be IPc, longitudinal sizes "a" of the intersections IPa on the basis of the intersections BP are within a range of 0.08A to 0.71A, and lateral sizes "b" of the intersections IPb on the basis of the intersections BP are within a range of 0.12B to 0.48B; and the intersections IPc are located close to the intersections BP rather than a straight line which connects the intersections IPa and the intersections IPb, and longitudinal sizes "a1" of the intersections IPc on the basis of the intersections BP are within a range of 0.01A to 0.70A and lateral sizes "b1" of the intersections IPc on the basis of the intersections BP are within a range of 0.01B to 0.47B.

According to this storage bag, by letting the longitudinal size "a" of the intersection IPa on the basis of the intersection BP be within a range of 0.08A to 0.71A and letting the lateral size "b" of the intersection IPb on the basis of the intersection BP be within a range of 0.12B to 0.48B, even as by locating the intersection IPc close to the intersection BP rather than the straight line which connects the intersection IPa and intersection IPb, and by letting the longitudinal size "a1" of the intersection IPc on the basis of the intersection BP be within a range of 0.01A to 0.70A and letting the lateral size "b1" of the intersection IPc on the basis of the intersection BP be within a range of 0.01B to 0.47B, it is possible to enable self-supporting of the storage bag after storing contents, such as a liquid or powder, in a storage section.

The above-described object, other objects, features, and advantages of the present invention will become clear by the following descriptions and accompanying drawings.

BRIEF DESCRIPTION OF SEVERAL VIEWS OF THE DRAWINGS

FIG. 4 is a drawing showing test results;

FIG. 11 is a drawing showing test results;

DETAILED DESCRIPTION OF THE INVENTION

First Embodiment

Figure 1:
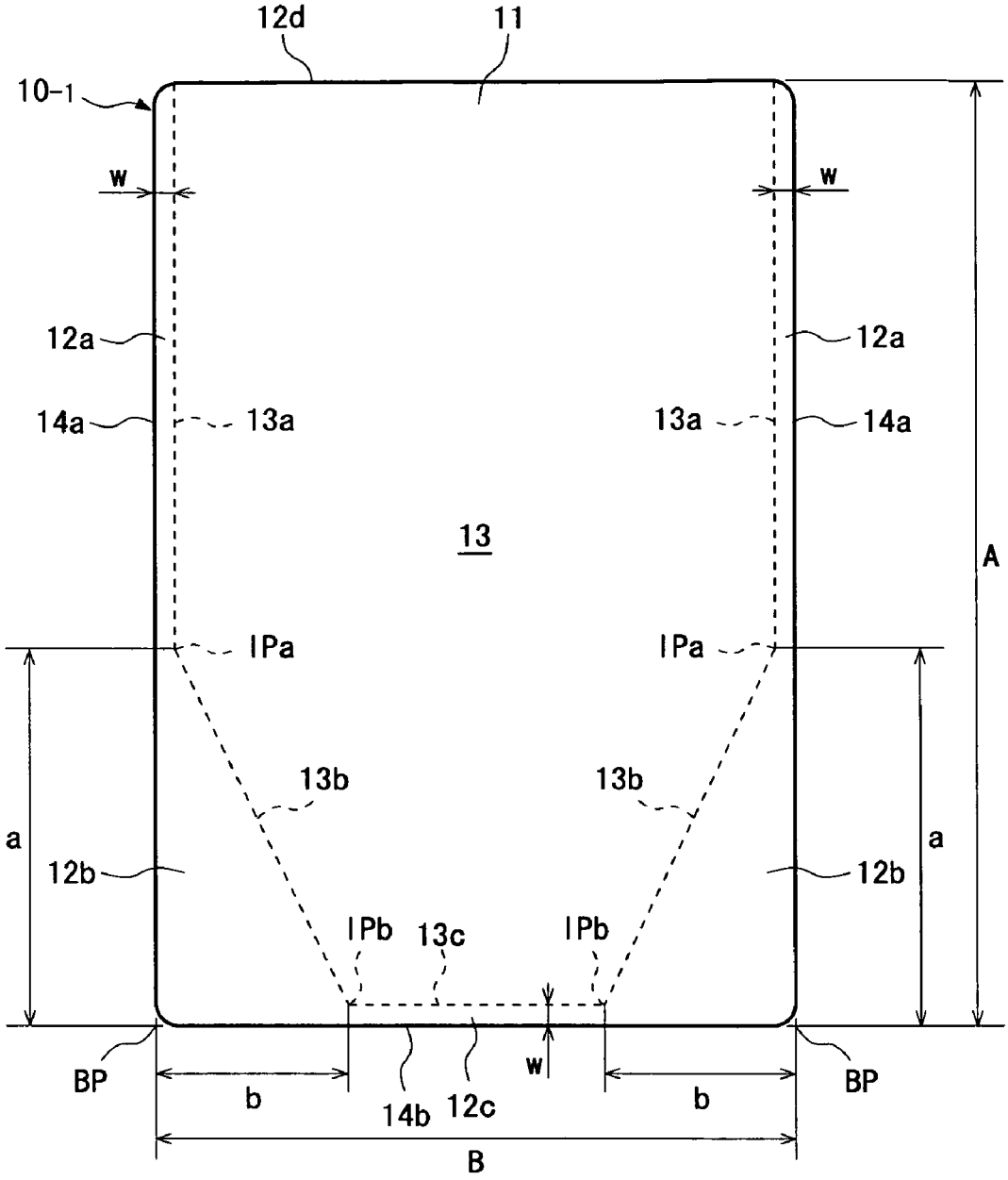
FIG. 1 is a side view of a three-sided bag showing a first embodiment of the present invention.

FIG. 1 shows a first embodiment in which the present invention is applied to a three-sided bag.

The three-sided bag 10-1 shown in FIG. 1 is formed from two sheets of films 11 with an identical shape. This three-sided bag 10-1 has two side upper portions 12*a* in a longitudinal direction each of which has a predetermined seal width "w", two side lower portions 12*b* with an approximately triangular seal shape, and one lower side 12*c* in a lateral direction with the predetermined seal width "w". In addition, this three-sided bag 10-1 has a storage section 13 with an upper opening (12*d* of reference numeral) inside.

Each film 11 comprises a multi-layer film which can be heat sealed, that is, a multi-layer film or the like with three layer structure including a polyethylene terephthalate film, aluminum foil, and a linear low density polyethylene film.

Contour of the storage section 13 is formed of (1) two side inner lines 13*a* in a longitudinal direction which exist inside each side upper portion 12*a*, (2) two tilt inner lines 13*b* which exist inside each side lower portion 12*b* and tilt inside with forming an obtuse angle with each side inner line 13*a* from a lower end of each side inner line 13*a*, and (3) one lower side inner line 13*c* in a lateral direction which exists inside the lower side 12*c* and connects lower ends of respective tilt inner lines 13*b*.

Length "A" in FIG. 1 denotes a whole longitudinal size of the three-sided bag 10-1, and length "B" denotes a whole lateral size of the three-sided bag 10-1. In addition, BP denotes an intersection of a side outer line 14*a* or its extension, and a lower side outer line 14*b* or its extension of the three-sided bag 10-1. Furthermore, IPa denotes an intersection of the side inner line 13*a* and tilt inner line 13*b*, and IPb denotes an intersection of the tilt inner line 13*b* and lower side inner line 13*c*. Moreover, length "a" denotes a longitudinal size of the intersection IPa on the basis of the intersection BP, and length "b" denotes a lateral size of the intersection IPb on the basis of the intersection BP.

In the three-sided bag 10-1 shown in FIG. 1, the longitudinal size "a" of the intersection IPa on the basis of the intersection BP is preferably within a range of 0.08A to 0.71A, and more preferably, it is within a range of 0.15A to 0.65A. In addition, the lateral size "b" of the intersection IPb on the basis of the intersection BP is preferably within a range of 0.12B to 0.48B, and more preferably, it is within a range of 0.20B to 0.40B.

The above-mentioned numeric value ranges are important matters so as to enable self-supporting of the three-sided bag 10-1 after storing contents, such as a liquid or powder, in the storage section 13. The above-mentioned numeric value ranges are selected on the basis of the test and test result which are described below.

At the time of the test, three-sided bags were produced, each of which has the whole longitudinal size "A" of 240 mm, the whole lateral size "B" of 160 mm, the seal width "w" of 5 mm, and a maximum storing amount of the storage section 13 of 800 cc, and comprised multi-layer films in which film 11 was made by stacking a 12-mm-thick polyethylene terephthalate film, a 7-mm-thick aluminum foil, and a 50-mm-thick linear low density polyethylene film through an adhesive layer, and which were kinds of three-sided bags corresponding to numerical value combination of locations with a "X" mark, a "Δ" mark, and a "○" in FIG. 4. Next, test bags were prepared, which were sealed by each upper opening of the storage section 13 being heat sealed (seal width of 5 mm) after an air vent being performed after 600-cc tap water being stored in the storage section 13 of each three-sided bag.

Figure 2:
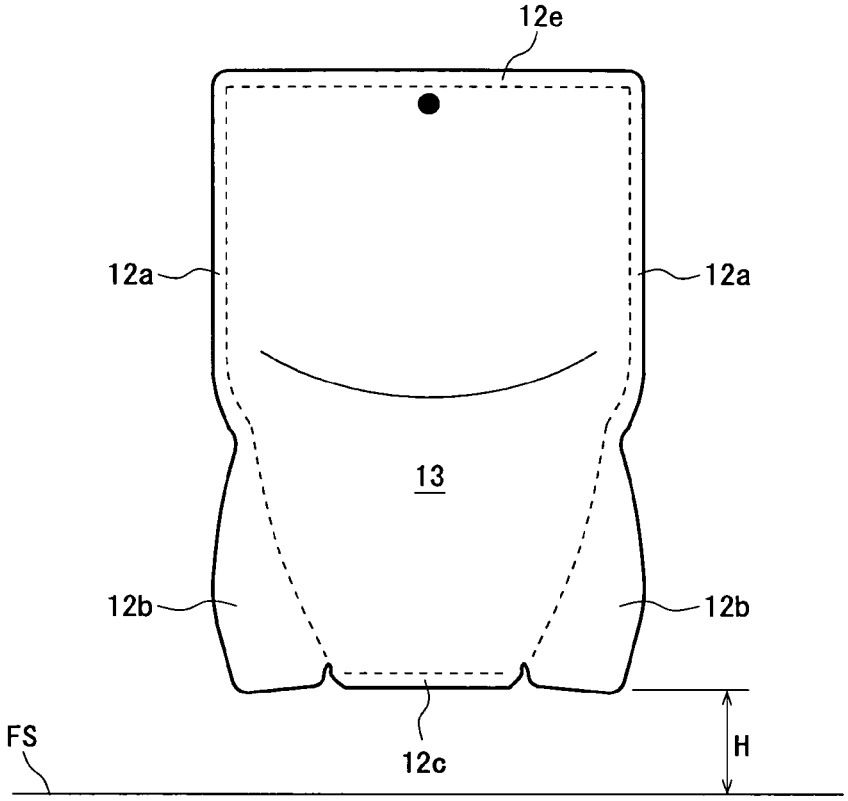
FIG. 2 is an explanatory diagram of a test method.
Figure 3:
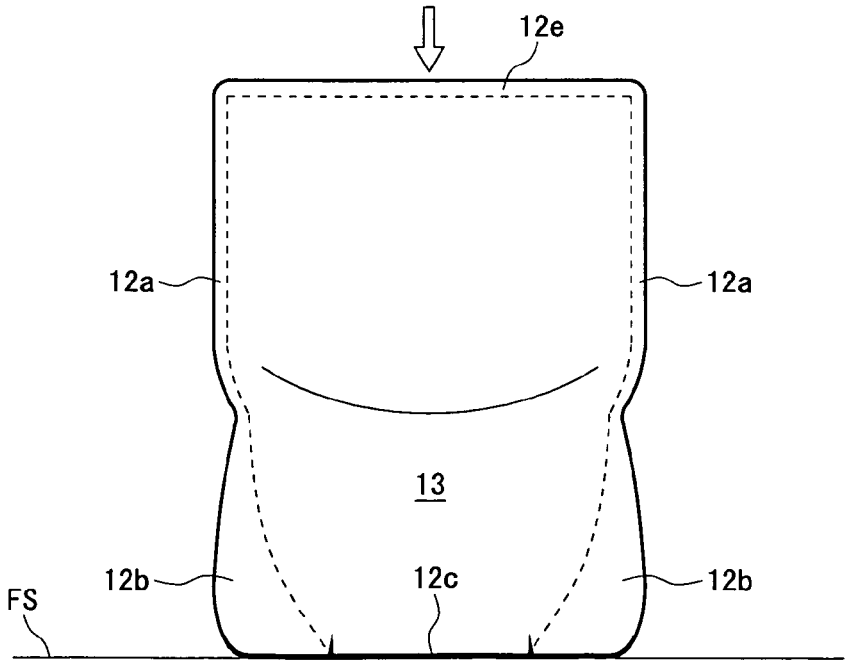
FIG. 3 is an explanatory diagram of the test method.

As shown in FIGS. 2 and 3, a test method comprised steps of holding an upper side central part (a black spot part in the diagram) of each test bag by fingertips and raising the test bag, performing five times of trials that the test bag was dropped by self weight to a horizontal plane FS from a place whose height H from the horizontal plane FS was 50 mm, and evaluating visually a landing state.

FIG. 4 shows a test result, a "X" mark in the drawing shows a case that a test bag fell and did not become self-supporting after landing even once among five trials, a "Δ" mark in the drawing shows a case that the test bag did not fall and became self-supporting, but there was a dispersion in a self-supporting posture in all the five trials, and a "○" mark shows a case that the test bag did not fall and became self-supporting in all the five trials, and there was no dispersion in a self-supporting posture in all the five trials.

The longitudinal size "a" in FIG. 4 is expressed in a percentage to the whole longitudinal size "A", and the lateral size "b" is expressed in a percentage to the whole lateral size "B". Although a unit of the percentage is based on 0.05, regarding a boundary between the "X" mark and "Δ" mark, and a boundary between the "Δ" mark and "○" mark, bordering validity is verified using a unit of a numerical value smaller than this according to necessity.

As apparent from the test result shown in FIG. 4, when sizes of the test bag are within the numeric value ranges described by the "Δ" marks, that is, the longitudinal size "a" of the intersection IPa is within the range of 0.08A to 0.71A and the lateral size "b" of the intersection IPb is within the range of 0.12B to 0.48B, the test bag can be made to become self-supporting satisfactorily. In addition, when the sizes are within the numeric value ranges described by the "○" marks, that is, the longitudinal size "a" of the intersection IPa is within the range of 0.15A to 0.65A and the lateral size "b" of the intersection IPb is within the range of 0.20B to 0.40B, the test bag can be made to become self-supporting in a further stable posture.

Since the tap water considered to be the hardest in a liquid to become self-supporting was used as contents stored in the storage section 13 in the above-mentioned test, even if the test is performed in a state of storing liquid, which has higher viscosity than tap water, or powder, which has fluidity inferior to a liquid, or the like, it is supposed that a result equivalent to that in FIG. 4 will be obtained.

Although a reason why it is possible to become self-supporting in the above-mentioned numeric value range is not certain, when observing test process in the test bags whose self-supporting was verified, in a state that the upper side central part (the black spot part in the drawing) of the test bag was held by fingertips and the bag was raised, tap water in the storage section 13 moved downward with its weight, and a lower portion of the storage section 13 expanded and swelled outside, and wrinkles (including wrinkles following a concavity and wrinkles following a bending as a concept) occurred in a lower surface of the test bag, and in particular, in portions, where nonlinear parts exist in inner lines, in connection with the swelling. When the test bag was dropped on the horizontal plane FS in this state, it becomes a form that a bottom end of the test bag was crushed with expansion of the wrinkles, and the test bag became self-supporting on the horizontal plane FS under an approximate surface contact state.

In this way, according to the storage bag 10-1 shown in FIG. 1, by letting the longitudinal size "a" of the intersection IPa on the basis of the intersection BP be within the range of 0.08A to 0.71A and letting the lateral size "b" of the intersection IPb on the basis of the intersection BP be within the range of 0.12B to 0.48B, it is possible to enable self-supporting of the three-sided bag 10-1 after storing contents, such as a liquid or powder, in the storage section 13.

In addition, by letting the longitudinal size "a" of the intersection IPa on the basis of the intersection BP be within the range of 0.15A to 0.65A and letting the lateral size "b" of the intersection IPb on the basis of the intersection BP be within the range of 0.20B to 0.40B, it is possible to enable self-supporting of the three-sided bag 10-1 in a further stable posture after storing contents, such as a liquid or powder, in a storage section 13.

Second Embodiment

Figure 5:
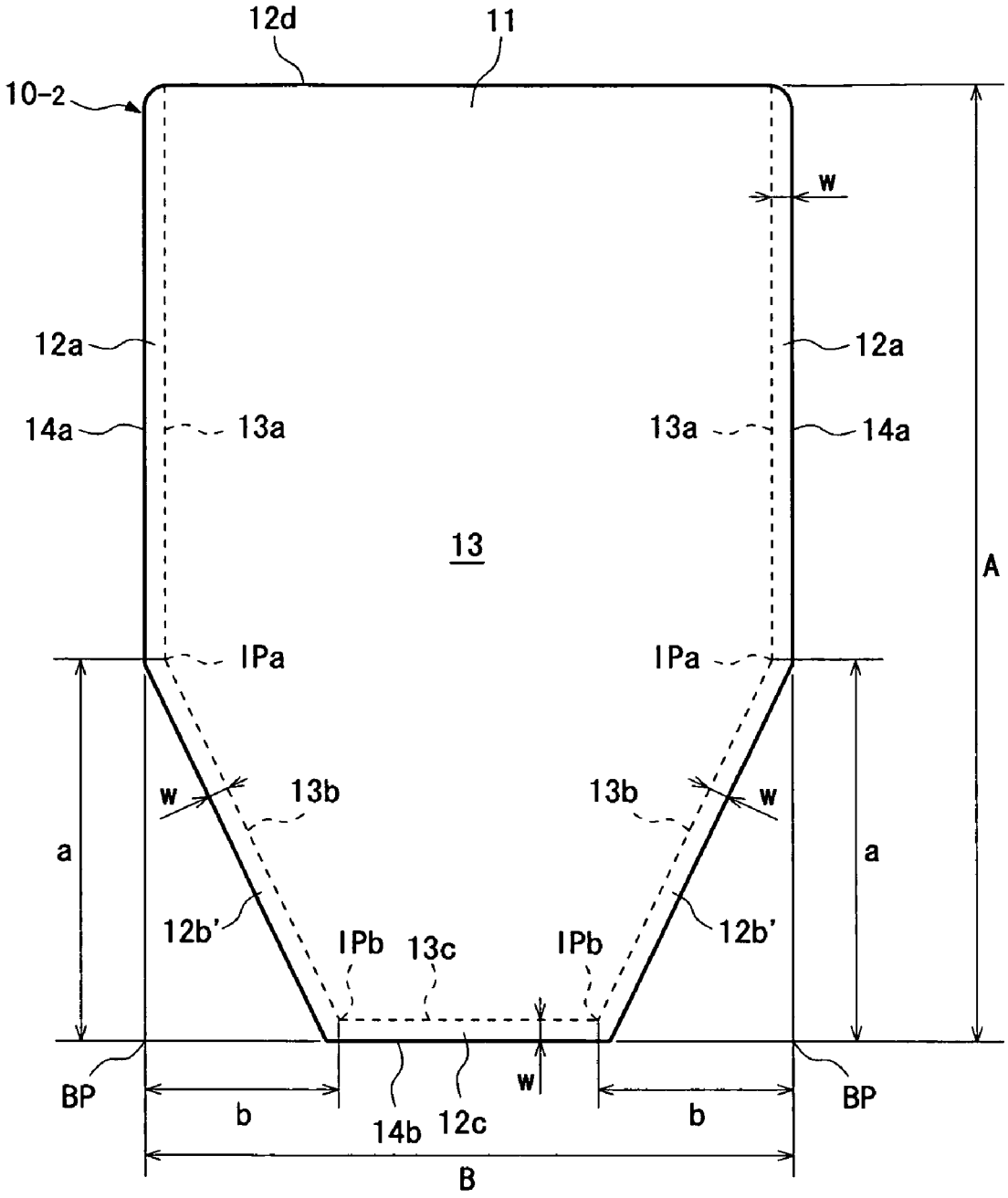
FIG. 5 is a side view of a three-sided bag showing a second embodiment of the present invention.

FIG. 5 shows a second embodiment in which the present invention is applied to a three-sided bag.

A different point of a three-sided bag 10-2, shown in FIG. 5, from the three-sided bag 10-1 shown in FIG. 1 is that each side lower portion 12*b* has a form (refer to reference numeral 12*b*') of having the almost same seal width "w" as the side upper portion 12*a*. Since other construction is the same as that of the three-sided bag 10-1 shown in FIG. 1, its description will be omitted using identical numeral characters.

Also in the three-sided bag 10-2 shown in FIG. 5, similarly to the three-sided bag 10-1 shown in FIG. 1, the longitudinal size "a" of the intersection IPa on the basis of the intersection BP is preferably within a range of 0.08A to 0.71A, and more preferably, it is within a range of 0.15A to 0.65A. In addition, the lateral size "b" of the intersection IPb on the basis of the intersection BP is preferably within a range of 0.12B to 0.48B, and more preferably, it is within a range of 0.20B to 0.40B.

The above-mentioned numeric value ranges are important matters so as to enable self-supporting of the three-sided bag 10-2 after storing contents, such as a liquid or powder, in the storage section 13. Since the above-mentioned numeric value ranges are selected on the basis of the result by the same test as what is described in the first embodiment and the test result is the same as what is shown in FIG. 4, its illustration will be omitted.

In this way, according to the three-sided bag 10-2 shown in FIG. 5, by letting the longitudinal size "a" of the intersection IPa on the basis of the intersection BP be within the range of 0.08A to 0.71A and letting the lateral size "b" of the intersection IPb on the basis of the intersection BP be within the range of 0.12B to 0.48B, it is possible to enable self-supporting of the three-sided bag 10-2 after storing contents, such as a liquid or powder, in the storage section 13.

In addition, by letting the longitudinal size "a" of the intersection IPa on the basis of the intersection BP be within the range of 0.15A to 0.65A and letting the lateral size "b" of the intersection IPb on the basis of the intersection BP be within the range of 0.20B to 0.40B, it is possible to enable self-supporting of the three-sided bag 10-2 in a further stable posture after storing contents, such as a liquid or powder, in a storage section 13.

Third Embodiment

Figure 6:
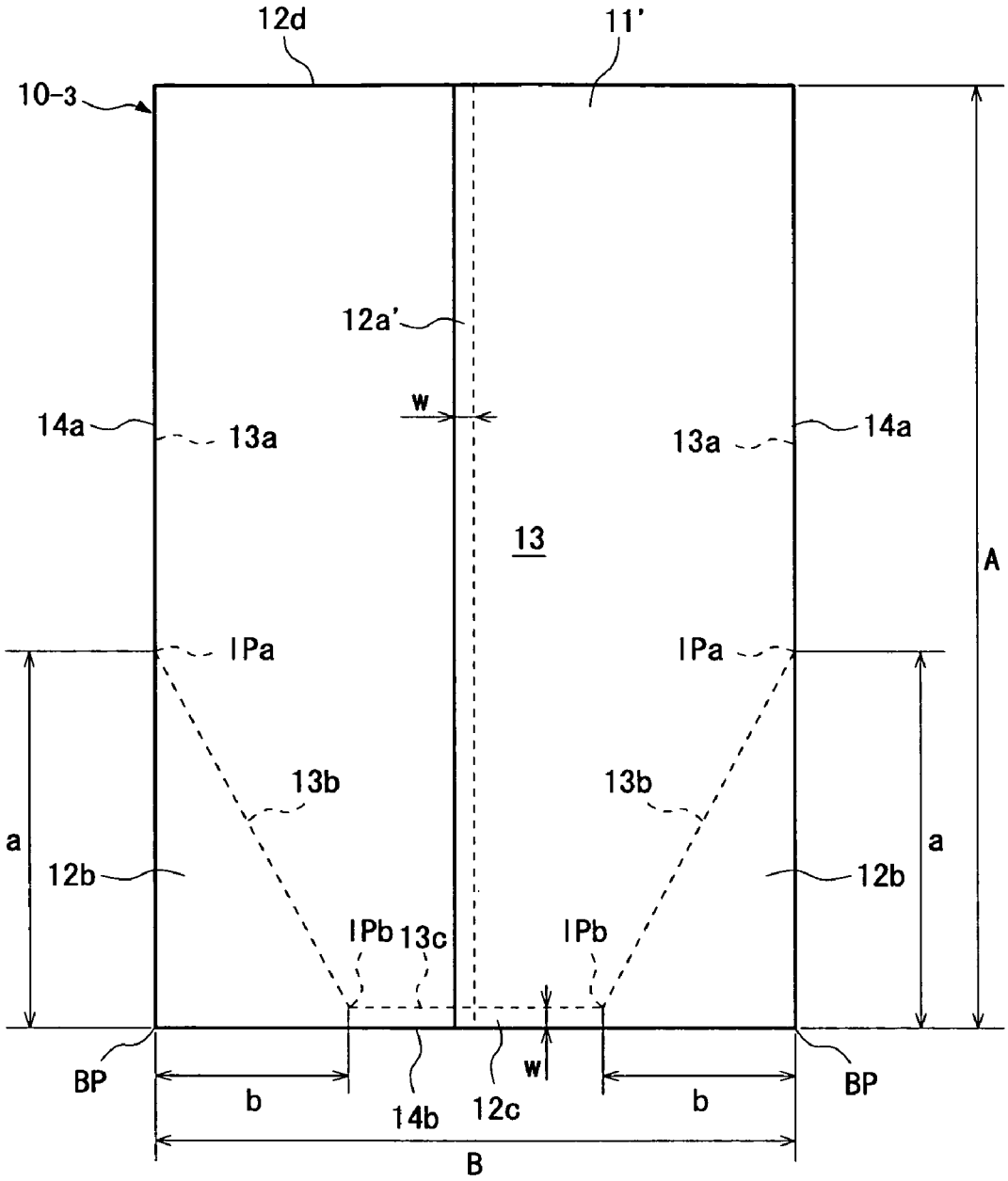
FIG. 6 is a side view of a twofold bag showing a third embodiment of the present invention.

FIG. 6 shows a third embodiment in which the present invention is applied to a twofold bag.

The twofold bag 10-3 shown in FIG. 6 is formed from one sheet of film 11' with a predetermined shape. This twofold bag 10-3 has one back side portion 12*a*' in a longitudinal direction which has predetermined seal width "w", two side lower portions 12*b* with an approximately triangular seal shape, and one lower side 12*c* in a lateral direction with the predetermined seal width "w". In addition, this twofold bag 10-3 has the storage section 13 with an upper opening (12*d* of reference numeral) inside.

In this twofold bag 10-3, the side upper portions 12*a* like the three-sided bag 10-1 shown in FIG. 1 do not exist, but two side inner lines 13*a* are formed by upper insides of right and left folded edges of the film 11'.

The film 11' comprises a multi-layer film which can be heat sealed, that is, a multi-layer film or the like with three layer structure including a polyethylene terephthalate film, aluminum foil, and a linear low density polyethylene film.

Contour of the storage section 13 is formed of (1) two side inner lines 13*a* in a longitudinal direction, (2) two tilt inner lines 13*b* which exist inside each side lower portion 12*b* and tilt inside with forming an obtuse angle with each side inner line 13*a* from a lower end of each side inner line 13*a*, and (3) one lower side inner line 13*c* in a lateral direction which exists inside the lower side 12*c* and connects lower ends of respective tilt inner lines 13*b*.

Length "A" in FIG. 6 denotes a whole longitudinal size of the twofold bag 10-3, and length "B" denotes a whole lateral size of the twofold bag 10-3. In addition, BP denotes an intersection of the side outer line 14*a* or its extension, and the lower side outer line 14*b* or its extension of the twofold bag 10-3. Furthermore, IPa denotes an intersection of the side inner line 13*a* and tilt inner line 13*b*, and IPb denotes an intersection of the tilt inner line 13*b* and lower side inner line 13*c*. Moreover, length "a" denotes a longitudinal size of the intersection IPa on the basis of the intersection BP, and length "b" denotes a lateral size of the intersection IPb on the basis of the intersection BP.

In the twofold bag 10-3 shown in FIG. 6, the longitudinal size "a" of the intersection IPa on the basis of the intersection BP is preferably within a range of 0.08A to 0.71A, and more preferably, it is within a range of 0.15A to 0.65A. In addition, the lateral size "b" of the intersection IPb on the basis of the intersection BP is preferably within a range of 0.12B to 0.48B, and more preferably, it is within a range of 0.20B to 0.40B.

The above-mentioned numeric value ranges are important matters so as to enable self-supporting of the twofold bag 10-3 after storing contents, such as a liquid or powder, in the storage section 13. Since the above-mentioned numeric value ranges are selected on the basis of the result by the same test as what is described in the first embodiment and the test result is the same as what is shown in FIG. 4, its illustration will be omitted.

In this way, according to the twofold bag 10-3 shown in FIG. 6, by letting the longitudinal size "a" of the intersection IPa on the basis of the intersection BP be within the range of 0.08A to 0.71A and letting the lateral size "b" of the intersection IPb on the basis of the intersection BP be within the range of 0.12B to 0.48B, it is possible to enable self-supporting of the twofold bag 10-3 after storing contents, such as a liquid or powder, in the storage section 13.

In addition, by letting the longitudinal size "a" of the intersection IPa on the basis of the intersection BP be within the range of 0.15A to 0.65A and letting the lateral size "b" of the intersection IPb on the basis of the intersection BP be within the range of 0.20B to 0.40B, it is possible to enable self-supporting of the twofold bag 10-3 in a further stable posture after storing contents, such as a liquid or powder, in a storage section 13.

Fourth Embodiment

Figure 7:
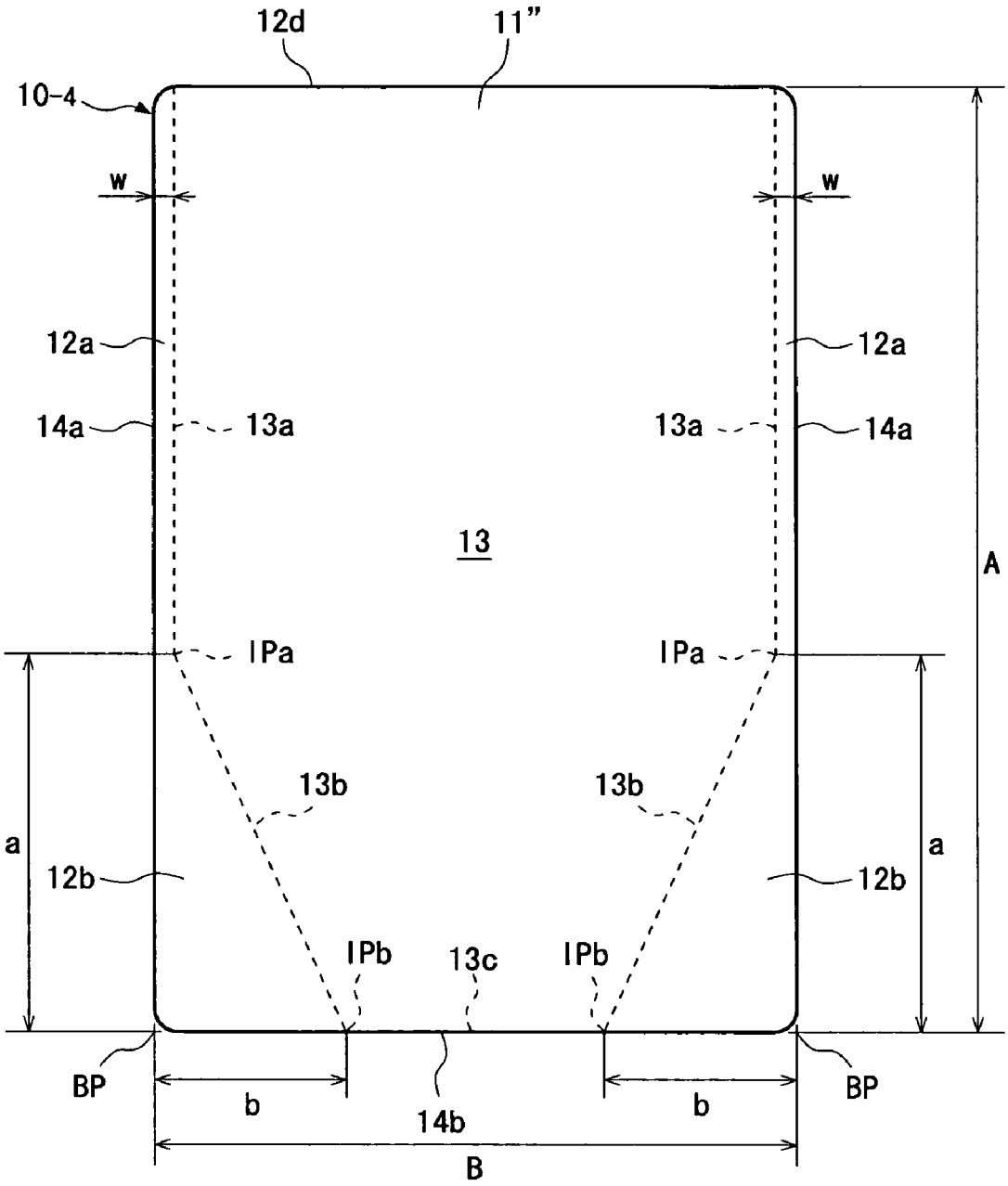
FIG. 7 is a side view of a two-sided bag showing a fourth embodiment of the present invention.

FIG. 7 shows a fourth embodiment in which the present invention is applied to a two-sided bag.

The two-sided bag 10-4 shown in FIG. 7 is formed from one sheet of film 11" with a predetermined shape. This two-sided bag 10-4 has two side upper portions 12*a* in a longitudinal direction each of which has predetermined seal width "w", and two side lower portions 12*b* each of which has an approximately triangular seal shape. In addition, this two-sided bag 10-4 has the storage section 13 with an upper opening (12*d* of reference numeral) inside.

In this two-sided bag 10-4, the lower side 12*c* like the three-sided bag 10-1 shown in FIG. 1 does not exist, but one lower side inner line 13*c* in a lateral direction is formed by a central inside of a lower folded edge of the film 11".

The film 11" comprises a multi-layer film which can be heat sealed, that is, a multi-layer film or the like with three layer structure including a polyethylene terephthalate film, aluminum foil, and a linear low density polyethylene film.

Contour of the storage section 13 is formed of (1) two side inner lines 13*a* in a longitudinal direction which exist inside each side upper portion 12*a*, (2) two tilt inner lines 13*b* which exist inside each side lower portion 12*b* and tilt inside with forming an obtuse angle with each side inner line 13*a* from a lower end of each side inner line 13*a*, and (3) one lower side inner line 13*c* in a lateral direction which connects lower ends of respective tilt inner lines 13*b*.

Length "A" in FIG. 7 denotes a whole longitudinal size of the two-sided bag 10-4, and length "B" denotes a whole lateral size of the two-sided bag 10-4. In addition, BP denotes an intersection of a side outer line 14*a* or its extension, and a lower side outer line 14*b* or its extension of the two-sided bag 10-4. Furthermore, IPa denotes an intersection of the side inner line 13*a* and tilt inner line 13*b*, and IPb denotes an intersection of the tilt inner line 13*b* and lower side inner line 13*c*. Moreover, length "a" denotes a longitudinal size of the intersection IPa on the basis of the intersection BP, and length "b" denotes a lateral size of the intersection IPb on the basis of the intersection BP.

In the two-sided bag 10-4 shown in FIG. 7, the longitudinal size "a" of the intersection IPa on the basis of the intersection BP is preferably within a range of 0.08A to 0.71A, and more preferably, it is within a range of 0.15A to 0.65A. In addition, the lateral size "b" of the intersection IPb on the basis of the intersection BP is preferably within a range of 0.12B to 0.48B, and more preferably, it is within a range of 0.20B to 0.40B.

The above-mentioned numeric value ranges are important matters so as to enable self-supporting of the two-sided bag 10-4 after storing contents, such as a liquid or powder, in the storage section 13. Since the above-mentioned numeric value ranges are selected on the basis of a result by the same test as what was described in the first embodiment and the test result is the same as what is shown in FIG. 4, its illustration will be omitted.

In this way, according to the two-sided bag 10-4 shown in FIG. 7, by letting the longitudinal size "a" of the intersection IPa on the basis of the intersection BP be within the range of 0.08A to 0.71A and letting the lateral size "b" of the intersection IPb on the basis of the intersection BP be within the range of 0.12B to 0.48B, it is possible to enable self-supporting of the two-sided bag 10-4 after storing contents, such as a liquid or powder, in the storage section 13.

In addition, by letting the longitudinal size "a" of the intersection IPa on the basis of the intersection BP be within the range of 0.15A to 0.65A and letting the lateral size "b" of the intersection IPb on the basis of the intersection BP be within the range of 0.20B to 0.40B, it is possible to enable self-supporting of the two-sided bag 10-4 in a further stable posture after storing contents, such as a liquid or powder, in a storage section 13.

MODIFIED EXAMPLES RELATING TO FIRST TO FOURTH EMBODIMENTS

First Modified Example

Figure 8:
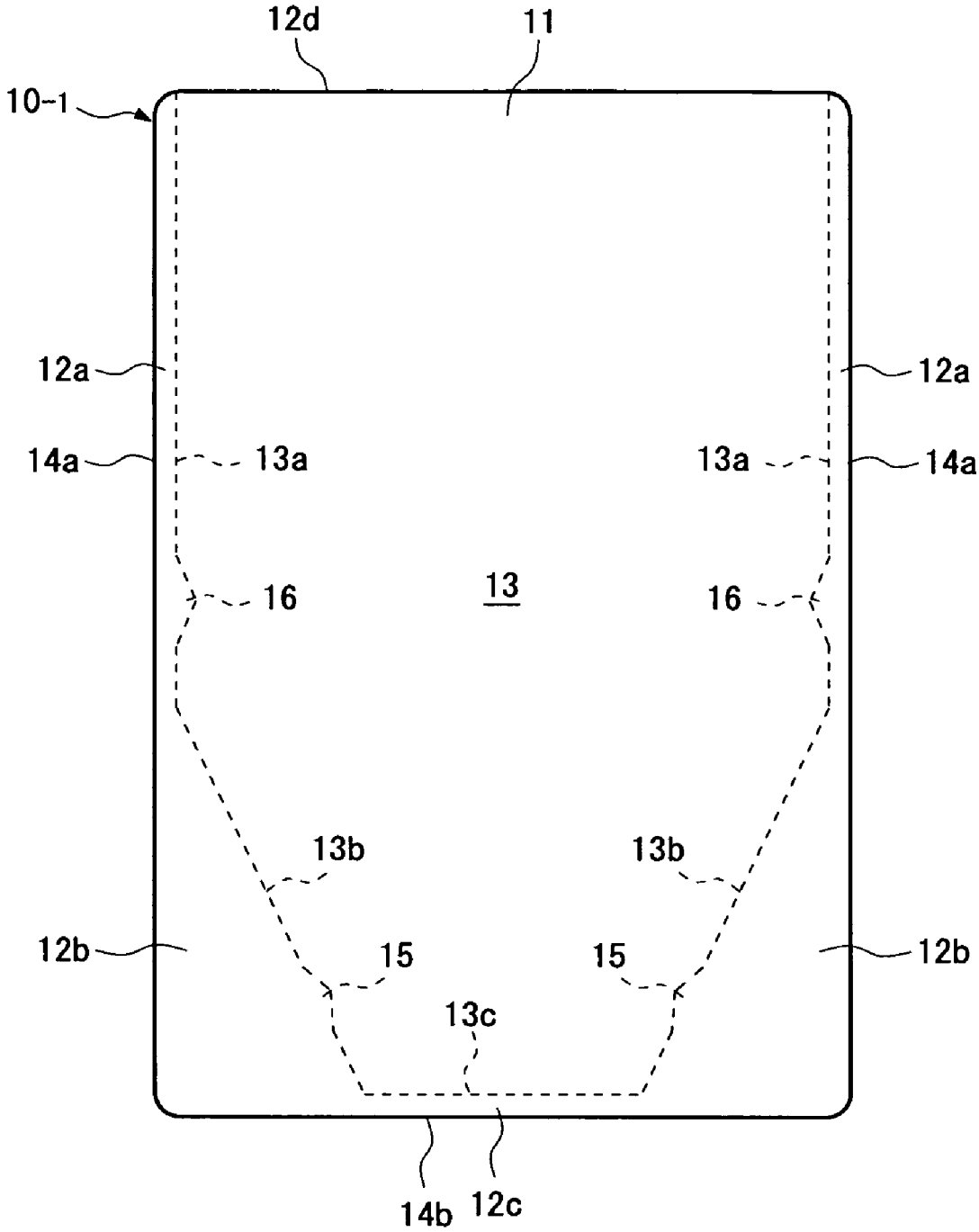
FIG. 8 is a diagram showing a first modified example relating to the first to fourth embodiments.

Different points of a three-sided bag 10-1 shown in FIG. 8, from the three-sided bag 10-1 shown in FIG. 1 are a point of providing a wrinkle forming section 15 in a lower portion of each tilt inner line 13*b* as making the tilt inner line 13*b* overhang inside in a triangular shape, and a point of providing a wrinkle forming section 16 in a lower portion of each side inner line 13*a* as making the side inner line 13*a* overhang inside in a triangular shape. Each vertex angle of respective wrinkle forming sections 15 and 16 orients to the storage section 13.

As described in the "reason why self-supporting becomes possible" in the description of the first embodiment, it is guessed that a wrinkle generated in a lower surface of a test bag has good influence on the self-supporting of the test bag.

Here, in order to form a wrinkle in each lower location of the each tilt inner line 13*b* and each lower location of the each side inner line 13*a* of the three-sided bag 10-1 positively, the wrinkle forming section 15 is provided in the lower portion of the each tilt inner line 13*b*, even as the wrinkle forming section 16 is provided in the lower portion of the each side inner line 13*a*.

The wrinkle forming section 15 provided in the lower portion of the each tilt inner line 13*b* is effective in forming a wrinkle in the vicinity of the each wrinkle forming section 15 of the three-sided bag 10-1. On the other hand, the wrinkle forming section 16 provided in the lower portion of the each side inner line 13*a* is effective in forming a constriction in the vicinity of the each wrinkle forming section 16 of the three-sided bag 10-1.

In addition, although what provides one wrinkle forming section 15 in the each tilt inner line 13*b* and one wrinkle forming section 16 in the each side inner line 13*a* is shown in FIG. 8, it is also good (1) to provide two or more wrinkle forming sections 15 in the each tilt inner line 13*b* and two or more wrinkle forming sections 16 in the each side inner line 13*a*, (2) to adopt only one of the wrinkle forming section 15 and wrinkle forming section 16, and to exclude another one, (3) to provide one or more wrinkle forming section 15 only in one of the tilt inner lines 13*b*, or (4) to provide two or more wrinkle forming section 16 only in one of the side inner lines 13*a*. In short, when a wrinkle forming section is provided in at least one of the side inner lines 13*a* and tilt inner lines 13*b*, it acts on the self-supporting of the three-sided bag 10-1 effectively.

Of course, even if the same wrinkle forming section as described above is applied to the three-sided bag 10-2 shown in FIG. 5, the twofold bag 10-3 shown in FIG. 6, and the two-sided bag 10-4 shown in FIG. 7, it is possible to obtain the same operation and effect as the above-described.

Second Modified Example

Figure 9:
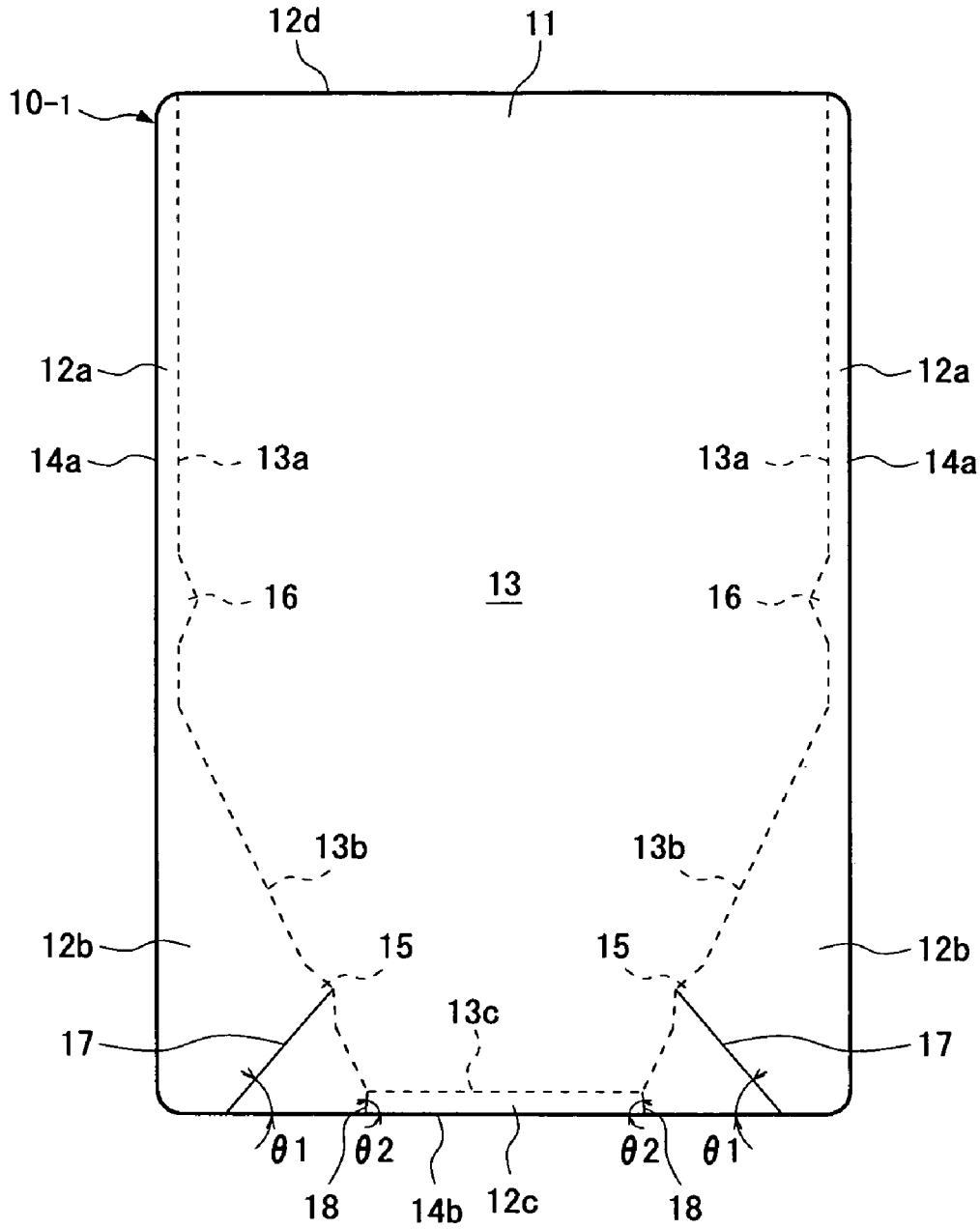
FIG. 9A and FIG. 9B are diagrams showing a second modified example relating to the first to fourth embodiments.
Figure 9:
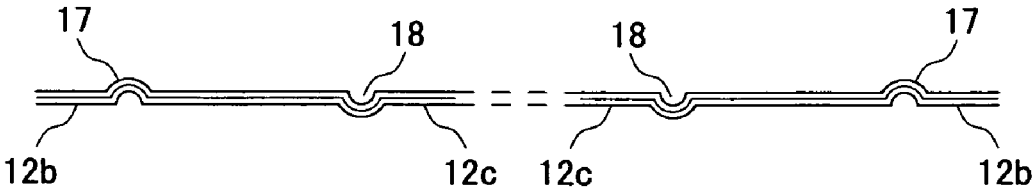

Different points of a three-sided bag 10-1 shown in FIG. 9A, from the three-sided bag 10-1 shown in FIG. 8 are a point of providing two folding lines 17 from the each wrinkle forming section 15 to the lower side outer line 14*b* in the each side lower portion 12*b*, and a point of providing two folding lines 18 from the intersection of the each tilt inner line 13*b* and lower side inner line 13*c* to the lower side outer line 14*b* in the each side lower portion 12*b*.

Since it is apparent that, as described in the "reason why self-supporting becomes possible" in the description of the first embodiment, a wrinkle generated in a lower surface of a test bag has good influence on the self-supporting of the test bag, here, two folding lines 17 and 18 are provided in the each side lower portion 12*b* respectively so as to form a wrinkle in the each side lower portion 12*b* of the three-sided bag 10-1 positively.

When the two folding lines 17 and 18 are provided in the respective side lower portion 12*b*, it is desirable to make the orientations of the two folding lines 17 and 18, which are adjacent, reverse as shown in FIG. 9B so that the each side lower portion 12*b* may bend finely in a section with a Z shape by each of the folding lines 17 and 18. In addition, although folds with a semicircular section are shown in FIG. 9B as folding lines 17 and 18, folds with a V-shaped section may be adopted. By the way, the respective folding lines 17 and 18 can be formed simply by press working or the like.

According to a test, by letting an angle q1, which one side of the folding line 17 forms with the lower side outer line 14*b*, be within a range of 21° to 79°, and letting an angle q2, which the other of the folding line 18 forms with the lower side outer line 14*b*, be within a range of 51° to 119°, it is possible to form a wrinkle along with the respective folding lines 17 and 18 effectively, and thereby, the each side lower portion 12*b* is finely bendable. Since the respective folding lines 17 and 18 are linear parts which bend easily in comparison with the other, even if respective angles q1 and q2 separate from the above-mentioned angular range to some extent, it is possible to fully perform wrinkle formation along with the respective folding lines 17 and 18.

In addition, although what provides two folding lines 17 and 18 in the each side lower portion 12*b* is shown in FIGS. 9A and 9B, it is also good (1) to provide three or more folding lines in the each side lower portion 12*b*, (2) to provide only one side of the folding line 17 and folding line 18 in the each side lower portion 12*b*, (3) to provide at least one or more out of the folding lines 17 and 18 only in one side of the side lower portions 12*b*. In short, when at least one folding line is provided in at least one of the two side lower portions 12*b*, it acts on the self-supporting of the three-sided bag 10-1 effectively.

Of course, even if the same folding line as the above-described is applied to the three-sided bag 10-2 shown in FIG. 5, the twofold bag 10-3 shown in FIG. 6, and the two-sided bag 10-4 shown in FIG. 7, it is possible to obtain the same operation and effect as the above-described.

In addition, as a substitution of the above-mentioned folding line, it is also good to use, for example, (1) a linear part in which short length slits are arranged in a shape of a broken line or (2) a linear part with small thickness. Although each bending direction of these linear parts cannot be specified like the above-mentioned folding line, since they are linear parts which bend easily in comparison with the other, they are effective for wrinkle formation. By the way, the linear parts of the above-described (1) and (2) can be formed simply similarly to the above-mentioned folding line by press working or the like.

Third Modified Example

Although what are linear as respective tilt inner lines 13*b* are shown in the first to fourth embodiments, the respective tilt inner lines 13*b* do not need to be true straight lines, but it is possible to obtain the same operation and effect as the above-described even if the respective tilt inner lines 13*b* curve to some extent, or even if the respective tilt inner lines 13*b* meander to some extent on the basis of tolerance of heat sealing.

Fifth Embodiment

Figure 10:
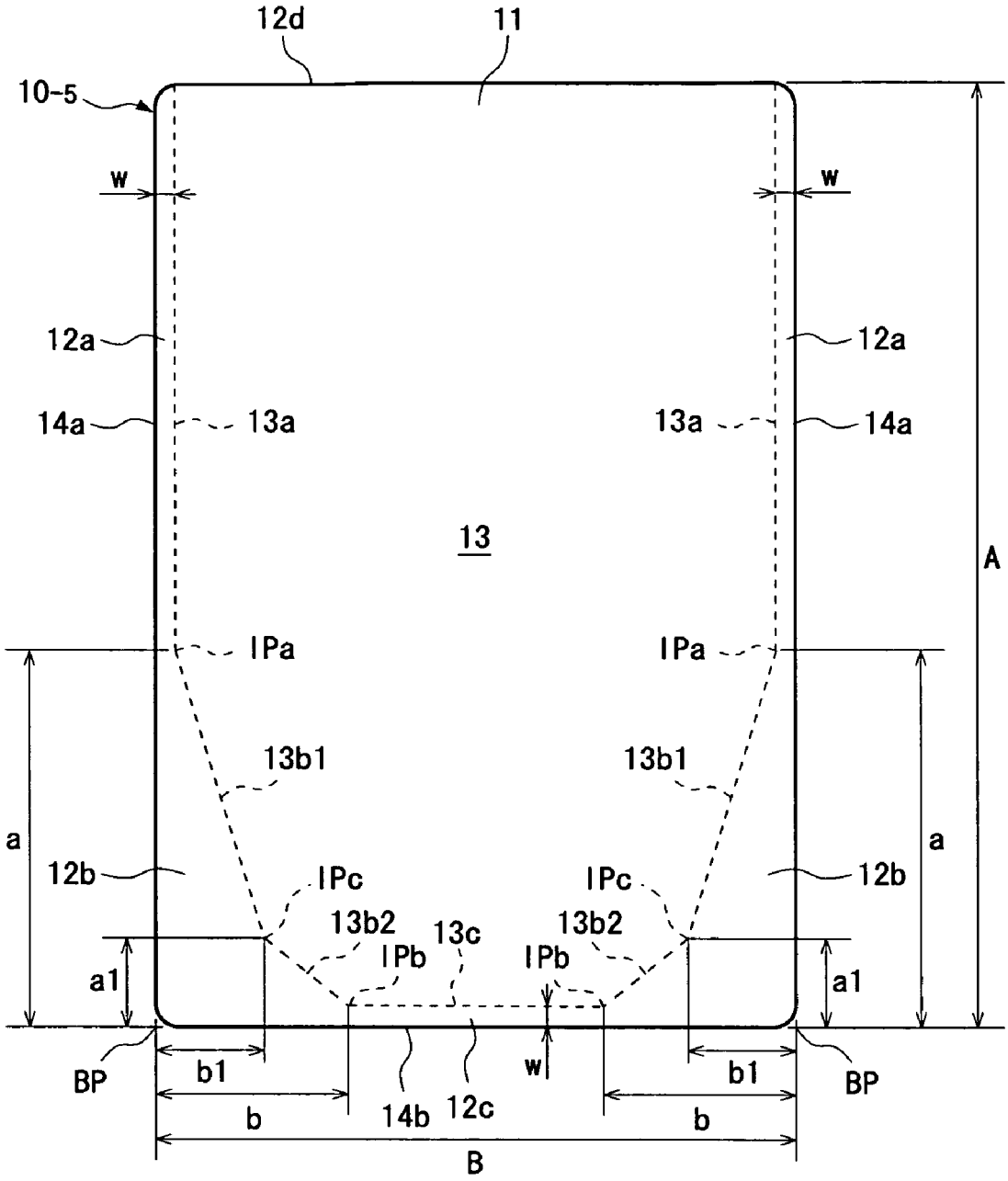
FIG. 10 is a side view of a three-sided bag showing a fifth embodiment of the present invention.

FIG. 10 shows a fifth embodiment in which the present invention is applied to a three-sided bag.

A three-sided bag 10-5 shown in FIG. 10 is formed from two sheets of films 11 with an identical shape. This three-sided bag 10-5 has two side upper portions 12*a* in a longitudinal direction each of which has predetermined seal width "w", two side lower portions 12*b* with an approximately triangular seal shape, and one lower side 12*c* in a lateral direction with the predetermined seal width "w" which is the same as that of the side upper portion 12*a*. In addition, this three-sided bag 10-5 has a storage section 13 with an upper opening (12*d* of reference numeral) inside.

Each film 11 comprises a multi-layer film which can be heat sealed, that is, a multi-layer film or the like with three layer structure including a polyethylene terephthalate film, aluminum foil, and a linear low density polyethylene film.

Contour of the storage section 13 is formed of (1) two side inner lines 13*a* in a longitudinal direction which exist inside each side upper portion 12*a*, (2) two first tilt inner lines 13*b*1 which exist in an upper portion inside each side lower portion 12*b* and tilt inside with forming an obtuse angle with each side inner line 13*a* from a lower end of each side inner line 13*a*, (3) two second tilt inner lines 13*b*2 which exist in a lower portion inside each side lower portion 12*b* and tilt inside with forming an obtuse angle with each first tilt inner line 13*b*1 from a lower end of each first tilt inner line 13*b*1, and (4) one lower side inner line 13*c* in a lateral direction which exists inside the lower side 12*c* and connects lower ends of respective second tilt inner lines 13*b*2.

Length "A" in FIG. 10 denotes a whole longitudinal size of the three-sided bag 10-5, and length "B" denotes a whole lateral size of the three-sided bag 10-5. In addition, BP denotes an intersection of a side outer line 14*a* or its extension, and a lower side outer line 14*b* or its extension of the three-sided bag 10-5. Furthermore, IPa denotes an intersection of the side inner line 13*a* and first tilt inner line 13*b*1, and IPb denotes an intersection of the second tilt inner line 13*b*2 and lower side inner line 13*c*. Moreover, IPc denotes an intersection of the first tilt inner line 13*b*1 and second tilt inner line 13*b*2. Moreover, length "a" denotes a longitudinal size of the intersection IPa on the basis of the intersection BP, and length "b" denotes a lateral size of the intersection IPb on the basis of the intersection BP. In addition, length "a1" denotes a longitudinal size of the intersection IPc on the basis of the intersection BP, and length "b1" denotes a lateral size of the intersection IPc on the basis of the intersection BP.

In short, the three-sided bag 10-5 shown in FIG. 10 is different in a point that the tilt inner line 13*b* of the three-sided bag 10-1 shown in FIG. 1 is constructed of two line segments (13*b*1 and 13*b*2) which form an obtuse angle and continue.

In the three-sided bag 10-5 shown in FIG. 10, the longitudinal size "a" of the intersection IPa on the basis of the intersection BP is preferably within a range of 0.08A to 0.71A, and more preferably, it is within a range of 0.15A to 0.65A. In addition, the lateral size "b" of the intersection IPb on the basis of the intersection BP is preferably within a range of 0.12B to 0.48B, and more preferably, it is within a range of 0.20B to 0.40B. Furthermore, the intersection IPc is located close to the intersection BP rather than the straight line which connects the intersection IPa and the intersection IPb, and the longitudinal size "a1" of the intersection IPc on the basis of the intersection BP is within a range of 0.01A to 0.70A and the lateral size "b1" of the intersection IPc on the basis of the intersection BP is within a range of 0.01B to 0.47B.

The above-mentioned numeric value ranges are important matters so as to enable self-supporting of the three-sided bag 10-5 after storing contents, such as a liquid or powder, in the storage section 13. The range of the longitudinal size "a" of the intersection IPa and the range of the lateral size "b" of the intersection IPb among the above-mentioned numeric value ranges are based on the test result shown in FIG. 4. That is, it is premised that, so long as the longitudinal size "a" of the intersection IPa is within the range of 0.08A to 0.71A and the lateral size "b" of the intersection IPb is within the range of 0.12B to 0.48B, it is possible to make a test bag after storing a liquid, powder, etc. become self-supporting without a problem. In addition, the ranges of the longitudinal size "a1" and lateral size "b1" of the intersection IPc are selected on the basis of the test and test result which are described below among the above-mentioned numeric value ranges.

At the time of the test, the same three-sided bags as what are described in the first embodiment, and the same kinds of three-sided bags corresponding to numerical combination in locations where round marks are marked in FIG. 11 were produced. Next, test bags were prepared, test bags which were sealed by each upper opening of the storage section 13 being heat sealed (seal width of 5 mm) after an air vent being performed after 600-cc tap water being stored in the storage section 13 of each three-sided bag.

Similarly to methods shown in FIGS. 2 and 3, a test method comprised steps of holding an upper side central part (a black spot part in the diagram) of each test bag by fingertips and raising the test bag, performing five times of trials that the test bag was dropped by self weight to a horizontal plane FS from a place whose height H from the horizontal plane FS was 50 mm, and evaluating visually a landing state.

FIG. 11 shows a test result, a "-" mark in the drawing denotes a point that the intersection IPc cannot be set, and a "○" mark denotes a point that the intersection IPc can be set and self-supporting is possible.

The longitudinal size "a1" in FIG. 11 is expressed in a percentage to the whole longitudinal size "A", and the lateral size "b1" is expressed in a percentage to the whole lateral size "B". Although a unit of the percentage is based on 0.05 or 0.04, regarding a boundary between the "-" mark and "○" mark, bordering validity is verified using a unit of a numerical value smaller than this according to necessity.

In addition, since the longitudinal size "a1" of the intersection IPc does not exceed a maximum (0.71A) of the longitudinal size "a" of the intersection IPa and the lateral size "b1" of the intersection IPc does not exceed a maximum (0.48B) of the lateral size "b" of the intersection IPb, a maximum of the longitudinal size "a1" of the intersection IPc was set at 0.71A and a maximum of the lateral size "b1" was set at 0.48B.

As apparent from the test result shown in FIG. 11, when sizes of the test bag are within the numeric value ranges described by the "○" marks, that is, the longitudinal size "a1" of the intersection IPc is within the range of 0.01A to 0.70A and the lateral size "b1" of the Intersection IPc is within the range of 0.01B to 0.47B, the test bag can be made to become self-supporting satisfactorily. However, since the intersection IPc must be close to the intersection BP rather than the straight line which connects the intersection IPa and intersection IPb in order to obtain the first tilt inner line 13*b*1 and second tilt inner line 13*b*2 in the above-mentioned three-sided bag 10-5, a condition that the intersection IPc is limited to what is located close to the intersection BP rather than the straight line which connects the intersection IPa and intersection IPb is attached to a substantial range.

Since the tap water considered to be the hardest in a liquid to become self-supporting was used as contents stored in the storage section 13 in the above-mentioned test, even if the test is performed in a state of storing liquid, which has higher viscosity than tap water, or powder, which has fluidity inferior to a liquid, or the like, it is supposed that a result equivalent to that in FIG. 11 will be obtained. By the way, a reason why self-supporting of the test bag becomes possible is as described in the first embodiment.

In this way, according to the three-sided bag 10-5 shown in FIG. 10, by letting the longitudinal size "a" of the intersection IPa on the basis of the intersection BP be within the range of 0.08A to 0.71A and letting the lateral size "b" of the intersection IPb on the basis of the intersection BP be within the range of 0.12B to 0.48B, even as by locating the intersection IPc close to the intersection BP rather than the straight line which connects the intersection IPa and intersection IPb, and by letting the longitudinal size "a1" of the intersection IPc on the basis of the intersection BP be within the range of 0.01A to 0.70A and letting the lateral size "b1" of the intersection IPc on the basis of the intersection BP be within the range of 0.01B to 0.47B, it is possible to enable self-supporting of the three-sided bag 10-5 after storing contents, such as a liquid or powder, in the storage section 13.

In addition, by letting the longitudinal size "a" of the intersection IPa on the basis of the intersection BP be within the range of 0.15A to 0.65A and letting the lateral size "b" of the intersection IPb on the basis of the intersection BP be within the range of 0.20B to 0.40B, it is possible to enable self-supporting of the three-sided bag 10-5 in a further stable posture after storing contents, such as a liquid or powder, in a storage section 13.

Sixth Embodiment

Figure 12:
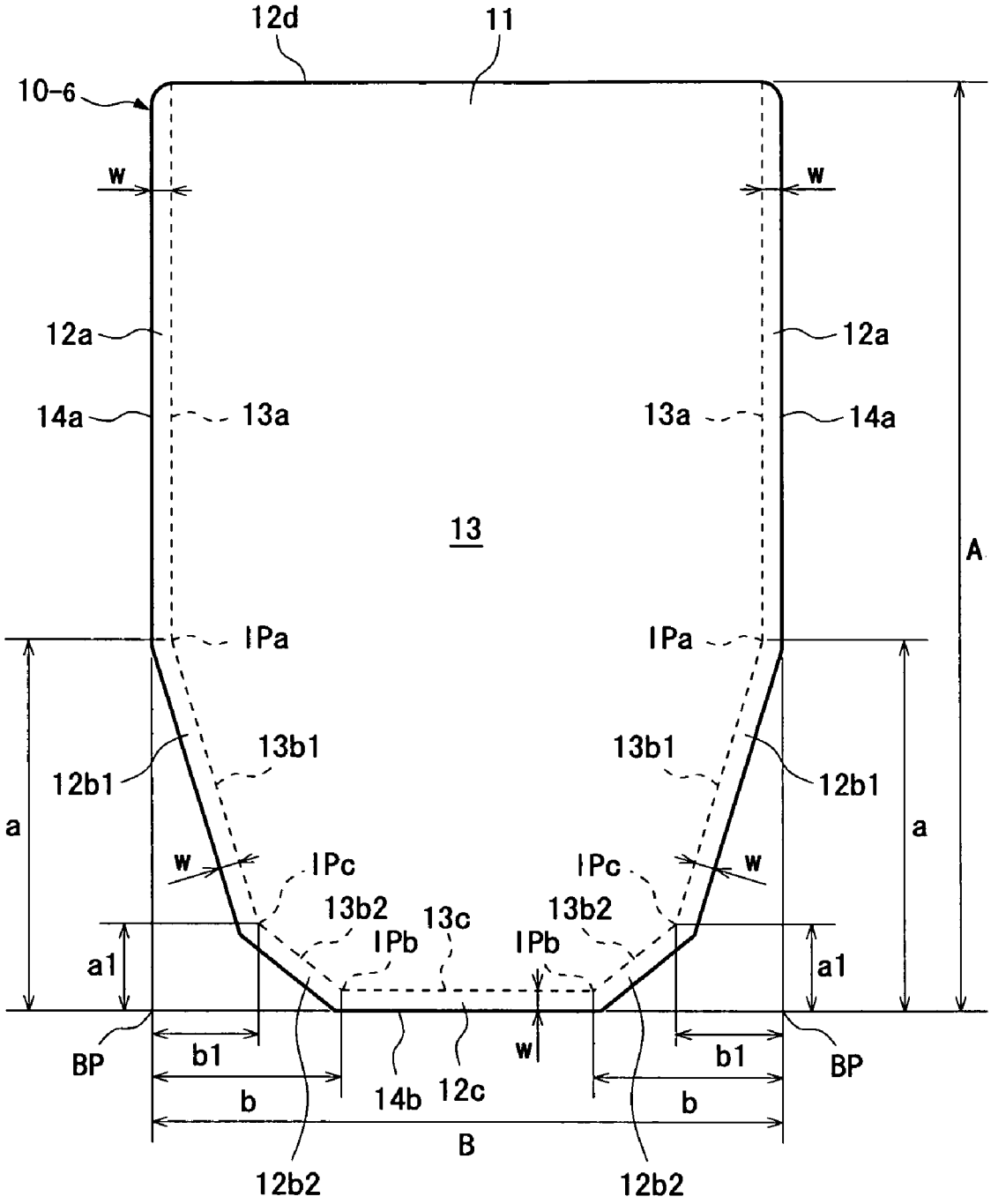
FIG. 12 is a side view of a three-sided bag showing a sixth embodiment of the present invention.

FIG. 12 shows a sixth embodiment in which the present invention is applied to a three-sided bag.

A different point of a three-sided bag 10-6, shown in FIG. 12, from the three-sided bag 10-5 shown in FIG. 10 is that each side lower portion 12*b* has a form (refer to reference numerals 12*b*1 and 12*b*2) of having the almost same seal width "w" as the side upper portion 12*a*. Since other construction is the same as that of the three-sided bag 10-5 shown in FIG. 10, its description will be omitted using identical numeral characters.

Also in the three-sided bag 10-6 shown in FIG. 12, similarly to the three-sided bag 10-5 shown in FIG. 10, the longitudinal size "a" of the intersection IPa on the basis of the intersection BP is preferably within a range of 0.08A to 0.71A, and more preferably, it is within a range of 0.15A to 0.65A. In addition, the lateral size "b" of the intersection IPb on the basis of the intersection BP is preferably within a range of 0.12B to 0.48B, and more preferably, it is within a range of 0.20B to 0.40B. Furthermore, the intersection IPc is located close to the intersection BP rather than the straight line which connects the intersection IPa and the intersection IPb, and the longitudinal size "a1" of the intersection IPc on the basis of the intersection BP is within a range of 0.01A to 0.70A and the lateral size "b1" of the intersection IPc on the basis of the intersection BP is within a range of 0.01B to 0.47B.

The above-mentioned numeric value ranges are important matters so as to enable self-supporting of the three-sided bag 10-6 after storing contents, such as a liquid or powder, in the storage section 13. Since the above-mentioned numeric value ranges are selected on the basis of the result by the same test as what is described in the first embodiment and the result by the same test as what is described in the fifth embodiment, both of the test results are the same as what are described in FIGS. 4 and 11, and hence, their illustration will be omitted.

In this way, according to the three-sided bag 10-6 shown in FIG. 12, by letting the longitudinal size "a" of the intersection IPa on the basis of the intersection BP be within the range of 0.08A to 0.71A and letting the lateral size "b" of the intersection IPb on the basis of the intersection BP be within the range of 0.12B to 0.48B, even as by locating the intersection IPc close to the intersection BP rather than the straight line which connects the intersection IPa and intersection IPb, and by letting the longitudinal size "a1" of the intersection IPc on the basis of the intersection BP be within the range of 0.01A to 0.70A and letting the lateral size "b1" of the intersection IPc on the basis of the intersection BP be within the range of 0.01B to 0.47B, it is possible to enable self-supporting of the three-sided bag 10-6 after storing contents, such as a liquid or powder, in the storage section 13.

In addition, by letting the longitudinal size "a" of the intersection IPa on the basis of the intersection BP be within the range of 0.15A to 0.65A and letting the lateral size "b" of the intersection IPb on the basis of the intersection BP be within the range of 0.20B to 0.40B, it is possible to enable self-supporting of the three-sided bag 10-6 in a further stable posture after storing contents, such as a liquid or powder, in a storage section 13.

Seventh Embodiment

Figure 13:
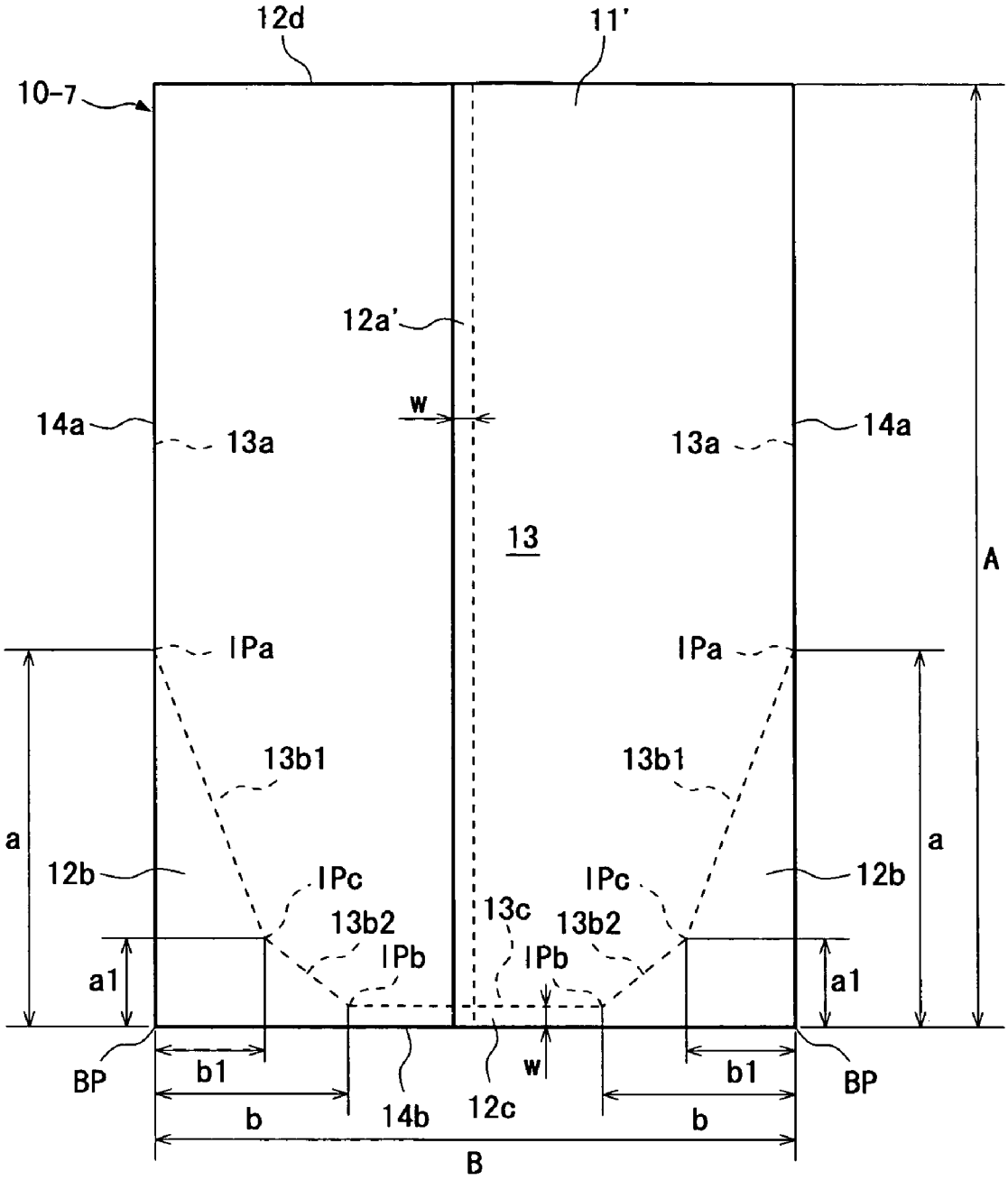
FIG. 13 is a side view of a twofold bag showing a seventh embodiment of the present invention.

FIG. 13 shows a seventh embodiment in which the present invention is applied to a twofold bag.

The twofold bag 10-7 shown in FIG. 13 is formed from one sheet of film 11' with a predetermined shape. This twofold bag 10-7 has one back side portion 12*a*' in a longitudinal direction which has predetermined seal width "w", two side lower portions 12*b* with an approximately triangular seal shape, and one lower side 12*c* in a lateral direction with the predetermined seal width "w". In addition, this twofold bag 10-7 has the storage section 13 with the upper opening (12*d* of reference numeral) inside.

In this twofold bag 10-7, the side upper portions 12*a* like the three-sided bag 10-5 shown in FIG. 10 do not exist, but two side inner lines 13*a* are formed by upper insides of right and left folded edges of the film 11'.

The film 11' comprises a multi-layer film which can be heat sealed, that is, a multi-layer film or the like with three layer structure including a polyethylene terephthalate film, aluminum foil, and a linear low density polyethylene film.

Contour of the storage section 13 is formed of (1) two side inner lines 13*a* in a longitudinal direction, (2) two first tilt inner lines 13*b*1 which exist in an upper portion inside each side lower portion 12*b* and tilt inside with forming an obtuse angle with each side inner line 13*a* from a lower end of each side inner line 13*a*, (3) two second tilt inner lines 13*b*2 which exist in a lower portion inside each side lower portion 12*b* and tilt inside with forming an obtuse angle with each first tilt inner line 13*b*1 from a lower end of each first tilt inner line 13*b*1, and (4) one lateral lower side inner line 13*c* which exists inside the lower side 12*c* and connects lower ends of respective second tilt inner lines 13*b*2.

Length "A" in FIG. 13 denotes a whole longitudinal size of the twofold bag 10-7, and length "B" denotes a whole lateral size of the twofold bag 10-7. In addition, BP denotes an intersection of the side outer line 14*a* or its extension, and the lower side outer line 14*b* or its extension of the twofold bag 10-7. Furthermore, IPa denotes an intersection of the side inner line 13*a* and first tilt inner line 13*b*1, and IPb denotes an intersection of the second tilt inner line 13*b*2 and lower side inner line 13*c*. Moreover, IPc denotes an intersection of the first tilt inner line 13*b*1 and second tilt inner line 13*b*2. Moreover, length "a" denotes a longitudinal size of the intersection IPa on the basis of the intersection BP, and length "b" denotes a lateral size of the intersection IPb on the basis of the intersection BP. In addition, length "a1" denotes a longitudinal size of the intersection IPc on the basis of the intersection BP, and length "b1" denotes a lateral size of the intersection IPc on the basis of the intersection BP.

In the twofold bag 10-7 shown in FIG. 13, the longitudinal size "a" of the intersection IPa on the basis of the intersection BP is preferably within a range of 0.08A to 0.71A, and more preferably, it is within a range of 0.15A to 0.65A. In addition, the lateral size "b" of the intersection IPb on the basis of the intersection BP is preferably within a range of 0.12B to 0.48B, and more preferably, it is within a range of 0.20B to 0.40B. Furthermore, the intersection IPc is located close to the intersection BP rather than the straight line which connects the intersection IPa and the intersection IPb, and the longitudinal size "a1" of the intersection IPc on the basis of the intersection BP is within a range of 0.01A to 0.70A and the lateral size "b1" of the intersection IPc on the basis of the intersection BP is within a range of 0.01B to 0.47B.

The above-mentioned numeric value ranges are important matters so as to enable self-supporting of the twofold bag 10-7 after storing contents, such as a liquid or powder, in the storage section 13. Since the above-mentioned numeric value ranges are selected on the basis of the result by the same test as what is described in the first embodiment and the result by the same test as what is described in the fifth embodiment, both of the test results are the same as what are described in FIGS. 4 and 11, and hence, their illustration will be omitted.

In this way, according to the twofold bag 10-7 shown in FIG. 13, by letting the longitudinal size "a" of the intersection IPa on the basis of the intersection BP be within the range of 0.08A to 0.71A and letting the lateral size "b" of the intersection IPb on the basis of the intersection BP be within the range of 0.12B to 0.48B, even as by locating the intersection IPc close to the intersection BP rather than the straight line which connects the intersection IPa and intersection IPb, and by letting the longitudinal size "a1" of the intersection IPc on the basis of the intersection BP be within the range of 0.01A to 0.70A and letting the lateral size "b1" of the intersection IPc on the basis of the intersection BP be within the range of 0.01B to 0.47B, it is possible to enable self-supporting of the twofold bag 10-7 after storing contents, such as a liquid or powder, in the storage section 13.

In addition, by letting the longitudinal size "a" of the intersection IPa on the basis of the intersection BP be within the range of 0.15A to 0.65A and letting the lateral size "b" of the intersection IPb on the basis of the intersection BP be within the range of 0.20B to 0.40B, it is possible to enable self-supporting of the twofold bag 10-7 in a further stable posture after storing contents, such as a liquid or powder, in a storage section 13.

Eighth Embodiment

Figure 14:
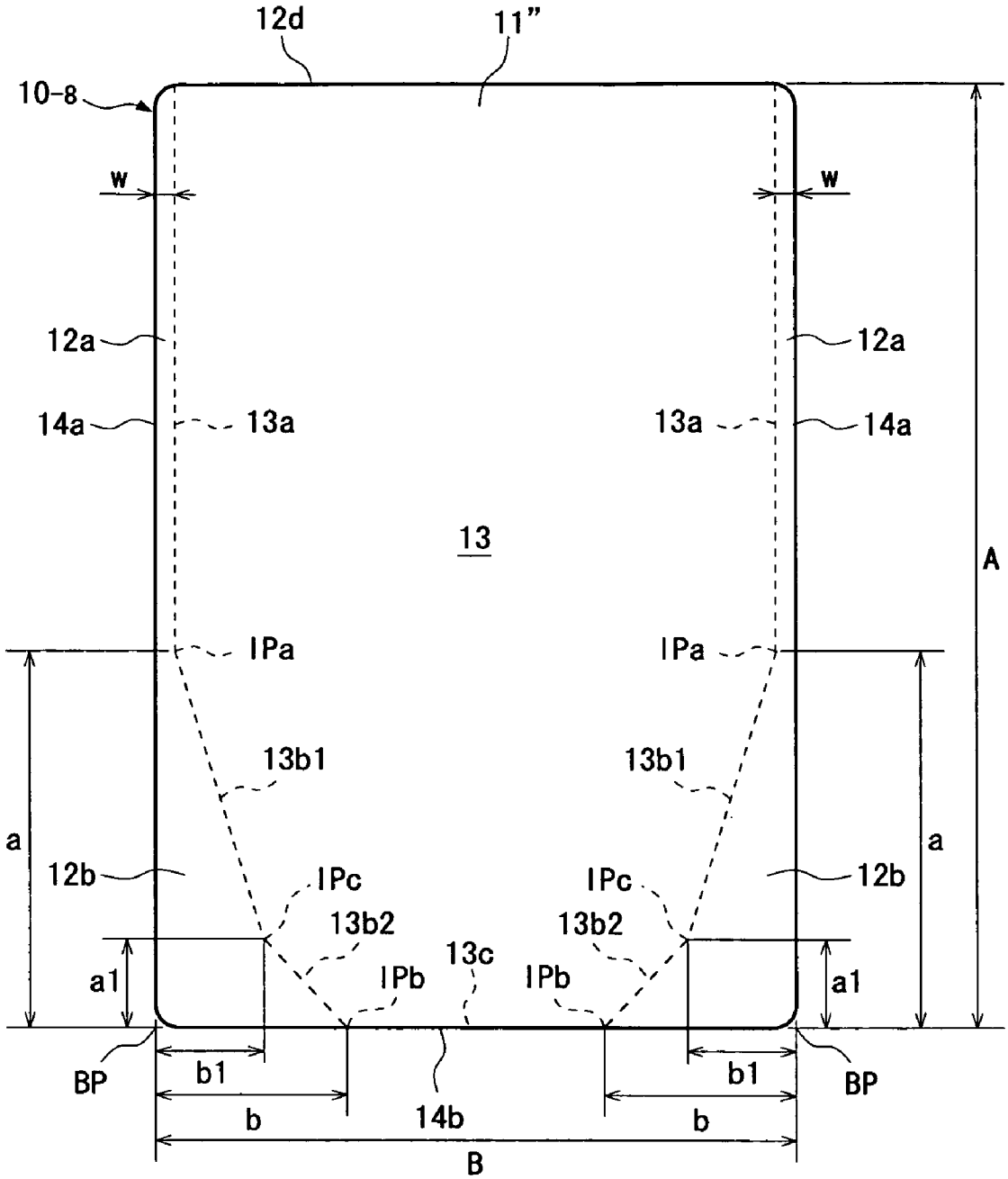
FIG. 14 is a side view of a two-sided bag showing an eighth embodiment of the present invention.

FIG. 14 shows an eighth embodiment in which the present invention is applied to a two-sided bag.

The two-sided bag 10-8 shown in FIG. 14 is formed from one sheet of film 11" with a predetermined shape. This two-sided bag 10-8 has two side upper portions 12*a* in a longitudinal direction each of which has predetermined seal width "w", and two side lower portions 12*b* each of which has an approximately triangular seal shape. In addition, this two-sided bag 10-8 has the storage section 13 with an upper opening (12*d* of reference numeral) inside.

In this two-sided bag 10-8, the lower side 12*c* like the three-sided bag 10-5 shown in FIG. 10 does not exist, but one lower side inner line 13*c* in a lateral direction is formed by a central inside of a folded edge of the film 11".

The film 11" comprises a multi-layer film which can be heat sealed, that is, a multi-layer film or the like with three layer structure including a polyethylene terephthalate film, aluminum foil, and a linear low density polyethylene film.

Contour of the storage section 13 is formed of (1) two side inner lines 13*a* in a longitudinal direction which exist inside each side upper portion 12*a*, (2) two first tilt inner lines 13*b*1 which exist in an upper portion inside each side lower portion 12*b* and tilt inside with forming an obtuse angle with each side inner line 13*a* from a lower end of each side inner line 13*a*, (3) two second tilt inner lines 13*b*2 which exist in a lower portion inside each side lower portion 12*b* and tilt inside with forming an obtuse angle with each first tilt inner line 13*b*1 from a lower end of each first tilt inner line 13*b*1, and (4) one lower side inner line 13*c* in a lateral direction which connects lower ends of respective second tilt inner lines 13*b*2.

Length "A" in FIG. 14 denotes a whole longitudinal size of the two-sided bag 10-8, and length "B" denotes a whole lateral size of the two-sided bag 10-8. In addition, BP denotes an intersection of a side outer line 14*a* or its extension, and a lower side outer line 14*b* or its extension of the two-sided bag 10-8. Furthermore, IPa denotes an intersection of the side inner line 13*a* and first tilt inner line 13*b*1, and IPb denotes an intersection of the second tilt inner line 13*b*2 and lower side inner line 13*c*. Moreover, IPc denotes an intersection of the first tilt inner line 13*b*1 and second tilt inner line 13*b*2. In addition, length "a" denotes a longitudinal size of the intersection IPa on the basis of the intersection BP, and length "b" denotes a lateral size of the intersection IPb on the basis of the intersection BP. In addition, length "a1" denotes a longitudinal size of the intersection IPc on the basis of the intersection BP, and length "b1" denotes a lateral size of the intersection IPc on the basis of the intersection BP.

In the two-sided bag 10-8 shown in FIG. 14, the longitudinal size "a" of the intersection IPa on the basis of the intersection BP is preferably within a range of 0.08A to 0.71A, and more preferably, it is within a range of 0.15A to 0.65A. In addition, the lateral size "b" of the intersection IPb on the basis of the intersection BP is preferably within a range of 0.12B to 0.48B, and more preferably, it is within a range of 0.20B to 0.40B. Furthermore, the intersection IPc is located close to the intersection BP rather than the straight line which connects the intersection IPa and the intersection IPb, and the longitudinal size "a1" of the intersection IPc on the basis of the intersection BP is within a range of 0.01A to 0.70A and the lateral size "b1" of the intersection IPc on the basis of the intersection BP is within a range of 0.01B to 0.47B.

The above-mentioned numeric value ranges are important matters so as to enable self-supporting of the two-sided bag 10-8 after storing contents, such as a liquid or powder, in the storage section 13. Since the above-mentioned numeric value ranges are selected on the basis of the result by the same test as what is described in the first embodiment and the result by the same test as what is described in the fifth embodiment, both of the test results are the same as what are described in FIGS. 4 and 11, and hence, their illustration will be omitted.

In this way, according to the two-sided bag 10-8 shown in FIG. 14, by letting the longitudinal size "a" of the intersection IPa on the basis of the intersection BP be within the range of 0.08A to 0.71A and letting the lateral size "b" of the intersection IPb on the basis of the intersection BP be within the range of 0.12B to 0.48B, even as by locating the intersection IPc close to the intersection BP rather than the straight line which connects the intersection IPa and intersection IPb, and by letting the longitudinal size "a1" of the intersection IPc on the basis of the intersection BP be within the range of 0.01A to 0.70A and letting the lateral size "b1" of the intersection IPc on the basis of the intersection BP be within the range of 0.01B to 0.47B, it is possible to enable self-supporting of the two-sided bag 10-8 after storing contents, such as a liquid or powder, in the storage section 13.

In addition, by letting the longitudinal size "a" of the intersection IPa on the basis of the intersection BP be within the range of 0.15A to 0.65A and letting the lateral size "b" of the intersection IPb on the basis of the intersection BP be within the range of 0.20B to 0.40B, it is possible to enable self-supporting of the two-sided bag 10-8 in a further stable posture after storing contents, such as a liquid or powder, in a storage section 13.

MODIFIED EXAMPLES RELATING TO FIFTH TO EIGHTH EMBODIMENTS

First Modified Example

Figure 15:
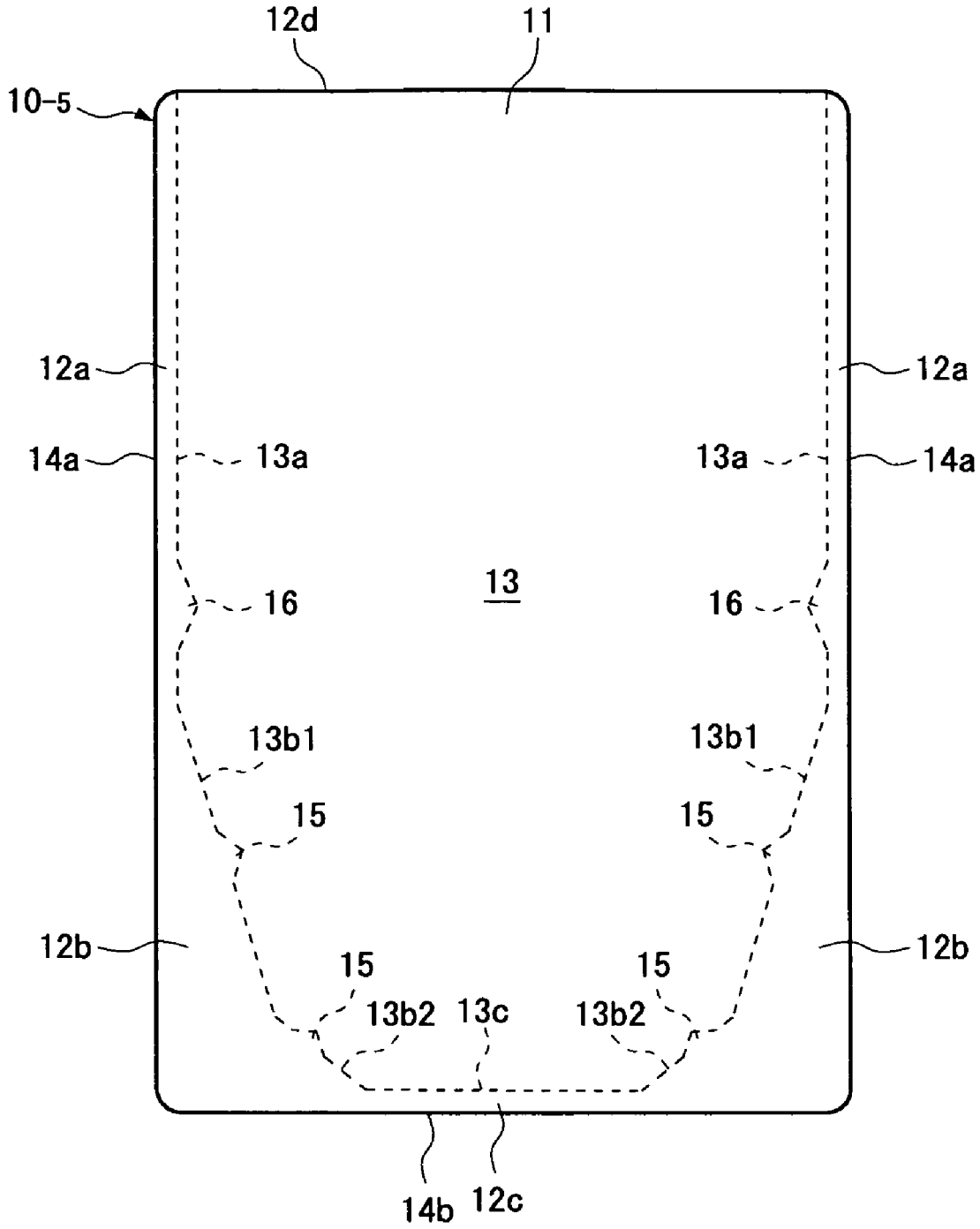
FIG. 15 is a diagram showing a first modified example relating to the fifth to eighth embodiments.

Different points of the three-sided bag 10-5 shown in FIG. 15, from the three-sided bag 10-5 shown in FIG. 10 are a point of providing a wrinkle forming section 15 in a middle portion of each first tilt inner line 13*b*1 as making the first tilt inner line 13*b*1 overhang inside in a triangular shape, a point of providing a wrinkle forming section 15 in a lower portion of each second tilt inner line 13*b*2 as making the second tilt inner line 13*b*2 overhang inside in a triangular shape, and a point of providing a wrinkle forming section 16 in a lower portion of each side inner line 13*a* as making the side inner line 13*a* overhang inside in a triangular shape. Each vertex angle of respective wrinkle forming sections 15 and 16 orients to the storage section 13.

As described in the "reason why self-supporting becomes possible" in the description of the first embodiment, it is guessed that a wrinkle generated in a lower surface of a test bag has good influence on the self-supporting of the test bag. Here, in order to form a wrinkle in each of a middle location of the each first tilt inner line 13*b*1, a lower location of the each second tilt inner line 13*b*2, and a lower location of the each side inner line 13*a* of the three-sided bag 10-5 positively, the wrinkle forming sections 15 are provided in a middle portion of the each first tilt inner line 13*b*1 and a lower portion of the each second tilt inner line 13*b*2 respectively, even as the wrinkle forming section 16 is provided in a lower portion of the each side inner line 13*a*.

The wrinkle forming section 15 provided in the lower portion of the each second tilt inner line 13*b*2 is effective in forming a wrinkle in the vicinity of the each wrinkle forming section 15 of the three-sided bag 10-5. On the other hand, the wrinkle forming sections 15 and 16 provided in the middle portion of the each first tilt inner line 13*b*1, and the lower portion of the each side inner line 13*a* respectively are effective in forming each constriction in the vicinity of the respective wrinkle forming sections 15 and 16 of the three-sided bag 10-5.

In addition, although what provides each one wrinkle forming section 15 in the each first tilt inner line 13*b*1 and the each second tilt inner line 13*b*2, and one wrinkle forming section 16 in the each side inner line 13*a* is shown in FIG. 15, it is also good (1) to provide two or more wrinkle forming sections 15 in the each first tilt inner line 13*b*1 and each second tilt inner line 13*b*2, and two or more wrinkle forming sections 16 in the each side inner line 13*a*, (2) to adopt only one of the wrinkle forming section 15 and wrinkle forming section 16, and to exclude another one, (3) to provide the wrinkle forming section 15 only in one of the first tilt inner line 13*b*1 and second tilt inner line 13*b*2, (4) to provide one or more wrinkle forming sections 15 only in at least one of one side of first tilt inner line 13*b*1 and one side of second tilt inner line 13*b*2, or (5) to provide one or more wrinkle forming sections 16 only in one side of side inner lines 13*a*. In short, when a wrinkle forming section is provided in at least one of the side inner lines 13*a*, first tilt inner lines 13*b*, and second tilt inner lines 13*b*2, it acts on the self-supporting of the three-sided bag 10-5 effectively.

Figure 16:
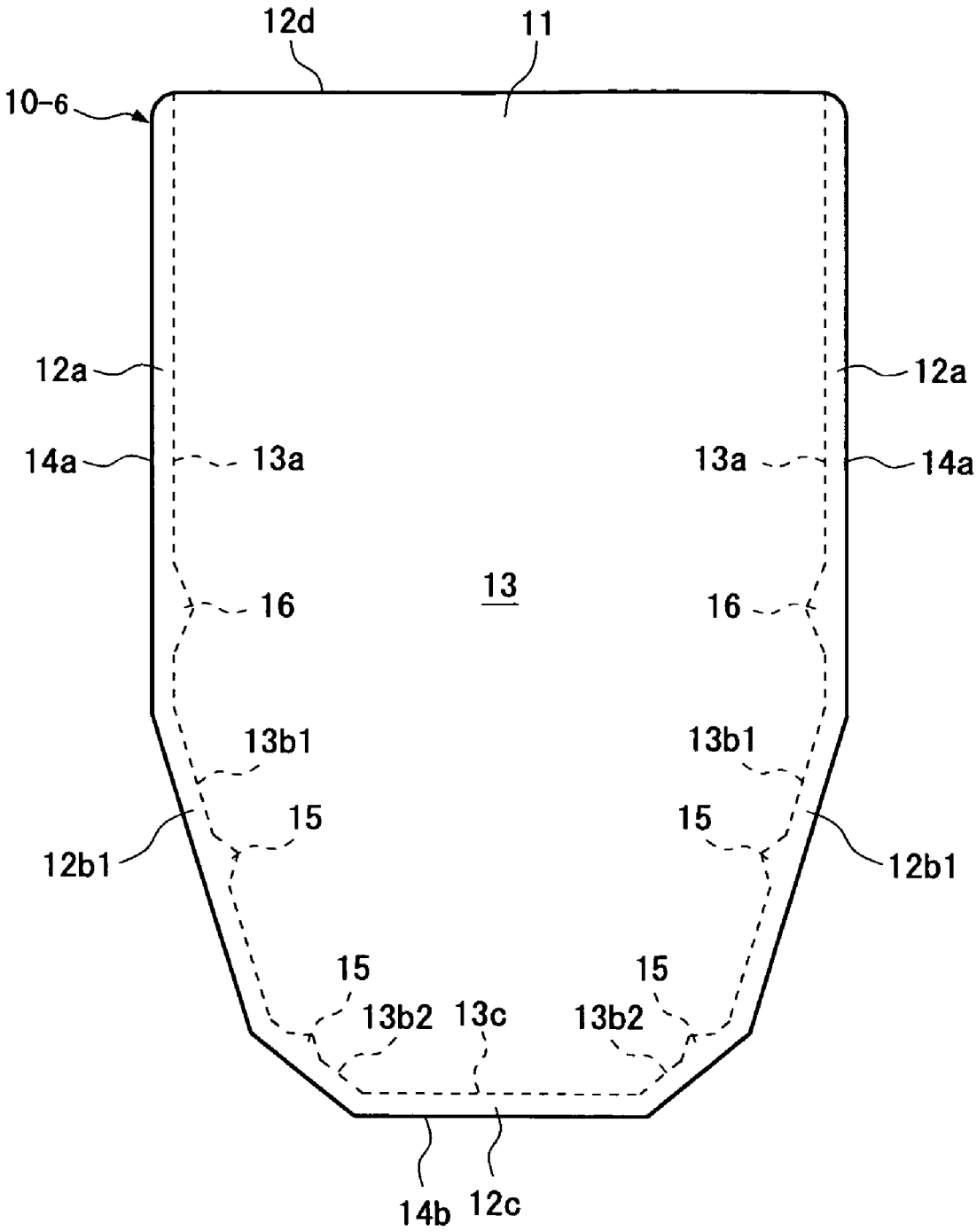
FIG. 16 is a diagram showing the first modified example relating to the fifth to eighth embodiments.

Of course, even if the same wrinkle forming section as described above is applied to the three-sided bag 10-6 shown in FIG. 12, the twofold bag 10-7 shown in FIG. 13, and the two-sided bag 10-8 shown in FIG. 14, it is possible to obtain the same operation and effect as the above-described. By the way, FIG. 16 shows what the same wrinkle forming section as the above-described is applied to the three-sided bag 10-6 shown in FIG. 12, the wrinkle forming section 15 is provided in a middle portion of each first tilt inner line 13*b*1 as making the first tilt inner line 13*b*1 overhang inside in a triangular shape, the wrinkle forming section 15 is provided in a lower portion of each second tilt inner line 13*b*2 as making the second tilt inner line 13*b*2 overhang inside in a triangular shape, and the wrinkle forming section 16 is provided in a lower portion of each side inner line 13*a* as making the side inner line 13*a* overhang inside in a triangular shape.

Second Modified Example

Figure 17:
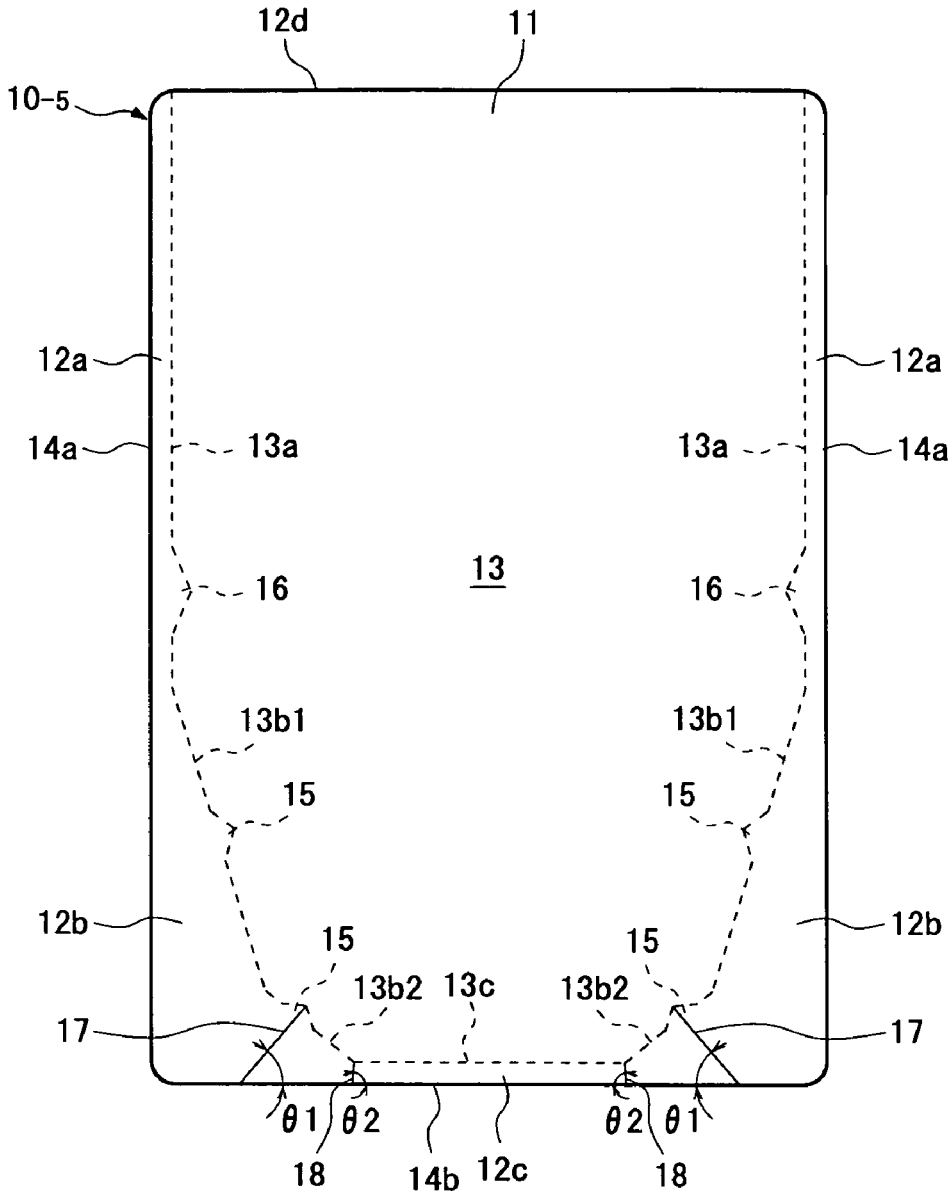
FIG. 17A and FIG. 17B are diagrams showing a second modified example relating to the fifth to eighth embodiments.
Figure 17:
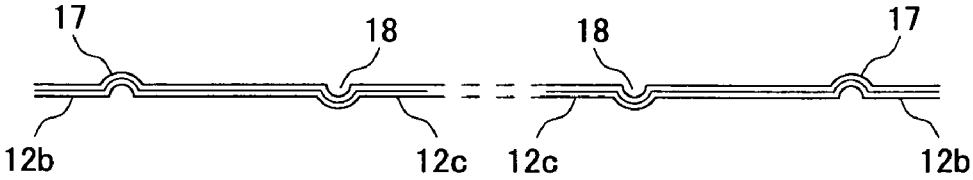

Different points of a three-sided bag 10-5 shown in FIG. 17A, from the three-sided bag 10-5 shown in FIG. 15 are a point of providing two folding lines 17 from the wrinkle forming section 15 of the each second tilt inner line 13*b*2 to the lower side outer line 14*b* in the each side lower portion 12*b*, and a point of providing two folding lines 18 from the intersection of the each second tilt inner line 13*b*2 and lower side inner line 13*c* to the lower side outer line 14*b* in the each side lower portion 12*b*.

Since it is apparent that, as described in the "reason why self-supporting becomes possible" in the description of the first embodiment, a wrinkle generated in a lower surface of a test bag has good influence on the self-supporting of the test bag, here, two folding lines 17 and 18 are provided in the each side lower portion 12*b* respectively so as to form a wrinkle in the each side lower portion 12*b* of the three-sided bag 10-5 positively.

When the two folding lines 17 and 18 are provided in the respective side lower portions 12*b*, it is desirable to make the orientations of the two folding lines 17 and 18, which are adjacent, reverse as shown in FIG. 17B so that the each side lower portion 12*b* may bend finely in a section with a Z shape by each of the folding lines 17 and 18. In addition, although folding lines with a semicircular section are shown in FIG. 17B as folding lines 17 and 18, folding lines with a V-shaped section may be adopted. By the way, the respective folding lines 17 and 18 can be formed simply by press working or the like.

According to a test, by letting an angle q1, which one side of the folding line 17 forms with the lower side outer line 14*b*, be within a range of 21° to 79°, and letting an angle q2, which the other of the folding line 18 forms with the lower side outer line 14*b*, be within a range of 51° to 119°, it is possible to form a wrinkle along with the respective folding lines 17 and 18 effectively, and thereby, the each side lower portion 12*b* is finely bendable. Since the respective folding lines 17 and 18 are linear parts which bend easily in comparison with the other, even if respective angles q1 and q2 separate from the above-mentioned angular range to some extent, it is possible to fully perform wrinkle formation along with the respective folding lines 17 and 18.

In addition, although what provides two folding lines 17 and 18 in the each side lower portion 12*b* is shown in FIGS. 17A and 17B, it is also good (1) to provide three or more folding lines in the each side lower portion 12*b*, (2) to provide only one side of the folding line 17 and folding line 18 in the each side lower portion 12*b*, and (3) to provide at least one or more out of the folding lines 17 and 18 only in one side of the side lower portions 12*b*. In short, when at least one folding line is provided in at least one of the two side lower portions 12*b*, it acts on the self-supporting of the three-sided bag 10-5 effectively.

Of course, even if the same folding line as described above is applied to the three-sided bag 10-6 shown in FIG. 12, the twofold bag 10-7 shown in FIG. 13, and the two-sided bag 10-8 shown in FIG. 14, it is possible to obtain the same operation and effect as the above-described.

In addition, as a substitution of the above-mentioned folding line, it is also good to use, for example, (1) a linear part in which short length slits are arranged in a shape of a broken line or (2) a linear part with small thickness. Although each bending direction of these linear parts cannot be specified like the above-mentioned folding line, since they are linear parts which bend easily in comparison with the other, they are effective for wrinkle formation. By the way, the linear part of the above-described (1) and (2) can be formed simply similarly to the above-mentioned folding line by press working or the like.

Third Modified Example

Figure 18:
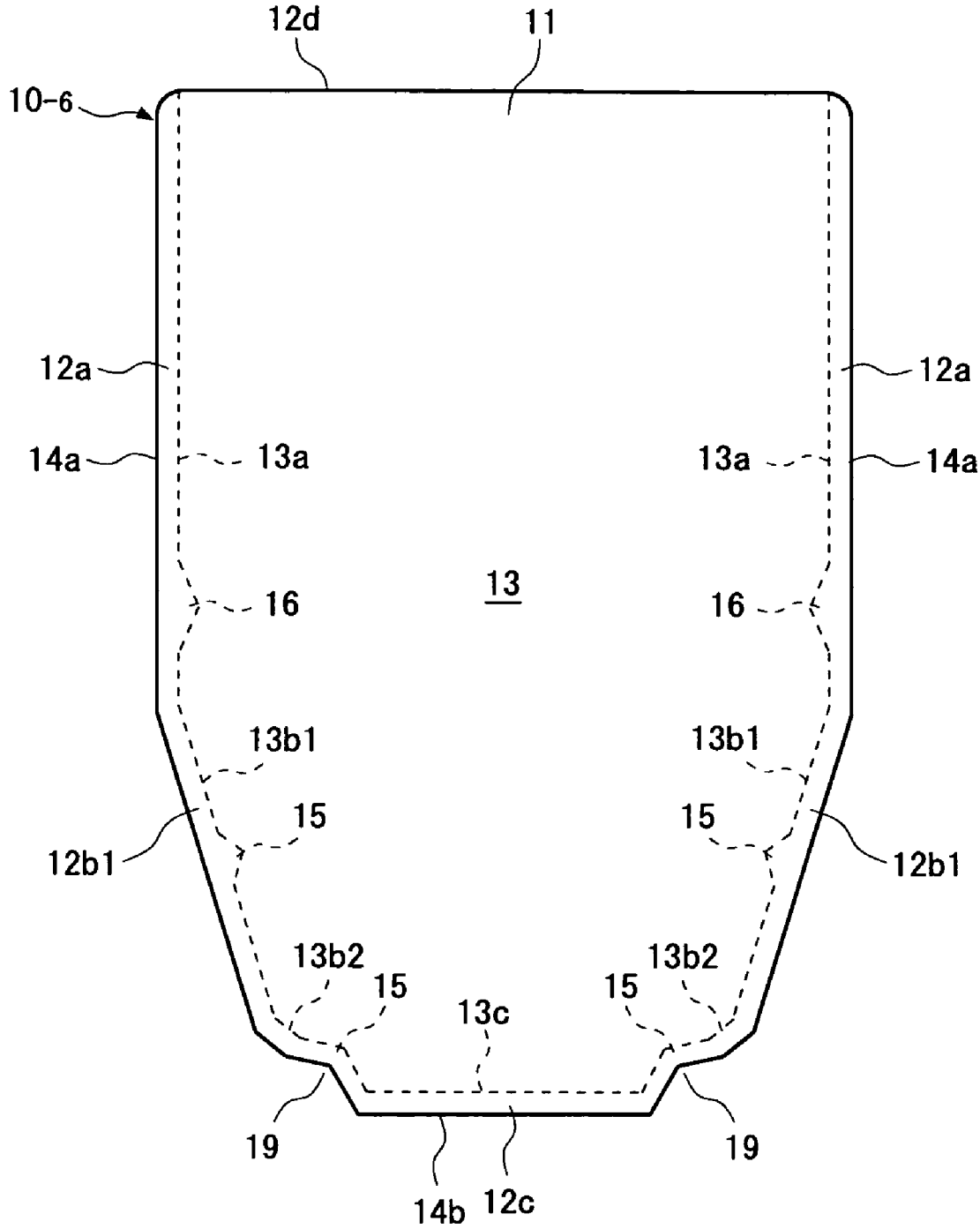
FIG. 18 is a diagram showing a third modified example relating to the fifth to eighth embodiments.

Different points of the three-sided bag 10-6 shown in FIG. 18, from the three-sided bag 10-6 shown in FIG. 16 are a point of providing a triangular wrinkle forming section 15 larger than the wrinkle forming section 15 of the three-sided bag 10-6 shown in FIG. 16 in the lower portion of the second tilt inner line 13*b*2, and a point of providing a triangular concave portion 19 along with contour of the wrinkle forming section 15 provided in the lower portion of the each second tilt inner line 13*b*2, in an outer line of each side lower portion 12*b*1.

When providing such a concave portion 19, even if seal width of each side lower portion 12*b*1 becomes large locally in relation to magnitude of the wrinkle forming section 15, it is possible to make the seal width of the respective side lower portions 12*b*1 identical as a whole, and thereby, it is possible to achieve reduction of material cost and the like.

Of course, depending on the magnitude of the wrinkle forming section, a concave portion corresponding to the wrinkle forming section 15 of the each first tilt inner line 13*b*1 or a concave portion corresponding to the wrinkle forming section 16 of the each side inner line 13*a* may be provided in an outer line of the each side lower portion 12*b*1.

Fourth Modified Example

Although what are linear as the each first tilt inner line 13*b*1 and each second tilt inner line 13*b*2 are shown in the fifth to eighth embodiments, the each first tilt inner line 13*b*1 and each second tilt inner line 13*b*2 do not need to be true straight lines, but it is possible to obtain the same operation and effect as the above-described even if the each first tilt inner line 13*b*1 and each second tilt inner line 13*b*2 curve to some extent, or even if the each first tilt inner line 13*b*1 and each second tilt inner line 13*b*2 meander to some extent on the basis of tolerance of heat sealing.

The embodiments mentioned in this specification are for purpose of exemplification only and are not intended as definitions of the limits. The scope of the present invention is shown by the appended claims and all the modified examples that fall into the meaning of these claims are included in the present invention.

The invention claimed is:

1. A storage bag which is a flat bag type storage bag including a three-sided bag, a twofold bag, and a two-sided bag; the storage bag having a predetermined whole longitudinal size, a predetermined whole lateral size, and a storage section with an upper opening; comprising:

a contour of the storage section being formed of two side inner lines in a longitudinal direction, two tilt inner lines which tilt inside with forming an obtuse angle with each of the side inner lines from lower ends of the side inner lines, and one lower side inner line in a lateral direction which connects lower ends of the tilt inner lines;

wherein with letting the whole longitudinal size be "A", letting the whole lateral size be "B", letting intersections of two side outer lines or their extensions, and a lower side outer line or its extension be BP, letting intersections of the side inner lines and the tilt inner lines be IPa, and letting intersections of the tilt inner lines and the lower side inner line be IPb, longitudinal sizes "a" of the intersections IPa on the basis of the intersections BP are within a range of 0.08A to 0.71A, and lateral sizes "b" of the intersections IPb on the basis of the intersections BP are within a range of 0.12B to 0.48B.

2. The storage bag according to claim 1, wherein:

in at least one of the side inner lines and the tilt inner lines, at least one wrinkle forming section overhanging inside from an inner line is provided.

3. The storage bag according to claim 2, wherein:

the wrinkle forming section has a triangular shape whose vertex angle orients to the storage section.

4. The storage bag according to claim 1, further comprising:

two side lower portions which are seal parts exist between the side outer lines and the tilt inner lines;

wherein in at least one of the side lower portions, at least one folding line for forming a wrinkle extending to an outer line from an inner line is provided.

5. The storage bag according to claim 4, wherein:

the folding line has a semicircular section or a V-shaped section.

6. The storage bag according to claim 1, further comprising:

two side lower portions which are seal parts exist between the side outer lines and the tilt inner lines; and two side upper portion which are seal parts exist between the side outer lines and the side inner lines;

wherein the side lower portions and the side upper portions have the almost same seal width.

7. A storage bag which is a flat bag type storage bag including a three-sided bag, a twofold bag, and a two-sided bag; the storage bag having a predetermined whole longitudinal size, a predetermined whole lateral size, and a storage section with an upper opening; comprising:

a contour of the storage section being formed of two side inner lines in a longitudinal direction, two first tilt inner lines which tilt inside with forming an obtuse angle with each of the side inner lines from lower ends of the side inner lines, two second tilt inner lines which tilt inside with forming an obtuse angle with each of the first tilt inner lines from lower ends of the first tilt inner lines, and one lower side inner line in a lateral direction which connects lower ends of the second tilt inner lines;

wherein with letting the whole longitudinal size be "A", letting the whole lateral size be "B", letting intersections of two side outer lines or their extensions, and a lower side outer line or its extension be BP, letting intersections of the side inner lines and the first tilt inner lines be IPa, letting intersections of the second tilt inner lines and the lower side inner line be IPb, and letting intersections of the first tilt inner lines and the second tilt inner lines be IPc, longitudinal sizes "a" of the intersections IPa on the basis of the intersections BP are within a range of 0.08A to 0.71A, and lateral sizes "b" of the intersections IPb on the basis of the intersections BP are within a range of 0.12B to 0.48B; and the intersections IPc are located close to the intersections BP rather than a straight line which connects the intersections IPa and the intersections IPb, and longitudinal sizes "a1" of the intersections IPc on the basis of the intersections BP are within a range of 0.01A to 0.70A and lateral sizes "b1" of the intersections IPc on the basis of the intersections BP are within a range of 0.01B to 0.47B.

8. The storage bag according to claim 7, wherein:

in at least one of the side inner lines, the first tilt inner lines, and the second tilt inner lines, at least one wrinkle forming section overhanging inside from an inner line is provided.

9. The storage bag according to claim 8, wherein:

the wrinkle forming section has a triangular shape whose vertex angle orients to the storage section.

10. The storage bag according to claim 7, further comprising:

two side lower portions which are seal parts exist between the side outer lines and the first and second tilt inner lines;

wherein in at least one of the side lower portions, at least one folding line for forming a wrinkle extending to an outer line from an inner line is provided.

11. The storage bag according to claim 10, wherein:

the folding line has a semicircular section or a V-shaped section.

12. The storage bag according to claim 7, further comprising:

two side lower portions which are seal parts exist between the side outer lines and the first and second tilt inner lines; and two side upper portions which are seal parts exist between the side outer lines and the side inner lines;

wherein the side lower portions and the side upper portions have the almost same seal width.

* * * * *